US007102126B2

(12) United States Patent
Bateman et al.

(10) Patent No.: US 7,102,126 B2
(45) Date of Patent: Sep. 5, 2006

(54) MASS SPECTROMETER

(75) Inventors: Robert Harold Bateman, Knutsford (GB); Jeff Brown, Hyde (GB)

(73) Assignee: Micromass UK Limited, Manchester (GB)

( * ) Notice: Subject to any disclaimer, the term of this patent is extended or adjusted under 35 U.S.C. 154(b) by 0 days.

(21) Appl. No.: 10/636,774

(22) Filed: Aug. 8, 2003

(65) Prior Publication Data

US 2004/0079874 A1 Apr. 29, 2004

Related U.S. Application Data

(60) Provisional application No. 60/422,088, filed on Oct. 30, 2002.

(30) Foreign Application Priority Data

Aug. 8, 2002 (GB) ..... 0218454.7

(51) Int. Cl.
*H01J 49/26* (2006.01)

(52) U.S. Cl. ..... 250/281; 250/282

(58) Field of Classification Search ..... 250/281, 250/282

See application file for complete search history.

(56) References Cited

U.S. PATENT DOCUMENTS

| | | | | |
|---|---|---|---|---|
| 5,399,857 | A | 3/1995 | Doroshenko et al. | |
| 5,696,376 | A | 12/1997 | Doroshenko et al. | |
| 6,285,027 | B1 * | 9/2001 | Chernushevich et al. | 250/287 |
| 6,287,872 | B1 | 9/2001 | Schurenberg et al. | |
| 6,504,148 | B1 | 1/2003 | Hager | |
| 6,545,268 | B1 | 4/2003 | Verentchikov et al. | |
| 6,570,151 | B1 | 5/2003 | Grosshans et al. | |
| 6,610,976 | B1 | 8/2003 | Chait et al. | |
| 2002/0121594 | A1 * | 9/2002 | Wang et al. | 250/281 |
| 2003/0066958 | A1 * | 4/2003 | Okumura et al. | 250/286 |
| 2003/0138823 | A1 | 7/2003 | Brock et al. | |
| 2003/0141447 | A1 * | 7/2003 | Verentchikov et al. | 250/287 |

FOREIGN PATENT DOCUMENTS

| | | |
|---|---|---|
| DE | 19806018 | 8/1998 |
| DE | 69419014 | 10/1999 |
| DE | 69330552 | 6/2002 |
| DE | 69901163 | 8/2002 |
| DE | 69622308 | 3/2003 |
| EP | 684628 | 11/1995 |
| EP | 1 367 631 A2 | 12/2003 |
| JP | 11-144675 | 5/1999 |
| WO | WO 99/39368 | 8/1999 |
| WO | WO 01/15201 | 3/2001 |

* cited by examiner

*Primary Examiner*—Nikita Wells
*Assistant Examiner*—Phillip A. Johnston
(74) *Attorney, Agent, or Firm*—Diederiks & Whitelaw PLC

(57) ABSTRACT

A mass spectrometer is disclosed wherein a relatively energetic pulse of ions having a relatively narrow spread of mass to charge ratios are ejected from a quadrupole ion trap and received in an ion trap upstream of a Time of Flight mass analyser. The ions are collisionally cooled within the ion trap and are pulsed out of the ion trap and into an extraction region of the Time of Flight mass analyser without substantially exciting the ions. This enables improved operation with the Time of Flight mass analyser. According to another embodiment, parent ions are fragmented and the resulting fragment ions are stored in two ion traps having different low mass cut-offs. The trapping system enables MS/MS experiments to be performed with a very high duty cycle.

47 Claims, 7 Drawing Sheets

| | Trap 1 (T1) | | | | Trap 2 (T2) | | | | Further Trap (T0) | | |
|---|---|---|---|---|---|---|---|---|---|---|---|
| | RF scan volts (0-pk) | | Ions stored (after scan) | | RF scan volts (0-pk) | | Ions stored (after scan) | | RF volts (0-pk) | Ions stored (after scan) | |
| | **low** | **high** | **m/z high** | **m\z low** | **low** | **high** | **m/z high** | **m/z low** | **static** | **m/z high** | **m/z low** |
| S1 | 913.8 | 913.8 | 3000 | 300 | 304.6 | 304.6 | 300 | 100 | 304.6 | empty | |
| S2 | 913.8 | 913.8 | 3000 | 300 | **304.6** | **609.2** | 300 | 200 | 304.6 | **200** | **100** |
| S3 | 913.8 | 913.8 | 3000 | 300 | 609.2 | 609.2 | 300 | 200 | gas+RFoff, ions pulsed into oa-tof, gas+RF on | | |
| S4 | 913.8 | 913.8 | 3000 | 300 | **609.2** | **913.8** | empty | | 609.2 | **300** | **200** |
| S5 | 913.8 | 913.8 | 3000 | 300 | 913.8 | 913.8 | empty | | gas+RFoff, ions pulsed into oa-tof, gas+RF on | | |
| S6 | **913.8** | **1827.6** | 3000 | 600 | 913.8 | 913.8 | 600 | 300 | 913.8 | empty | |
| S7 | 1827.6 | 1827.6 | 3000 | 600 | **913.8** | **1827.6** | empty | | 913.8 | **600** | **300** |
| S8 | 1827.6 | 1827.6 | 3000 | 600 | 1827.6 | 1827.6 | empty | | gas+RFoff, ions pulsed into oa-tof, gas+RF on | | |
| S9 | **1827.6** | **3655.2** | 3000 | 1200 | 1827.6 | 1827.6 | 1200 | 600 | 1827.6 | empty | |
| S10 | 3655.2 | 3655.2 | 3000 | 1200 | **1827.6** | **3655.2** | empty | | 1827.6 | **1200** | **600** |
| S11 | 3655.2 | 3655.2 | 3000 | 1200 | 3655.2 | 3655.2 | empty | | gas+RFoff, ions pulsed into oa-tof, gas+RF on | | |
| S12 | **3655.2** | **7310.5** | 3000 | 2400 | 3655.2 | 3655.2 | 2400 | 1200 | 3655.2 | empty | |
| S13 | 7310.5 | 7310.5 | 3000 | 2400 | **3655.2** | **7310.5** | empty | | 3655.2 | **2400** | **1200** |
| S14 | 7310.5 | 7310.5 | 3000 | 2400 | 7310.5 | 7310.5 | empty | | gas+RFoff, ions pulsed into oa-tof, gas+RF on | | |
| S15 | **7310.5** | **9138.1** | empty | | 7310.5 | 7310.5 | 3000 | 2400 | 7310.5 | empty | |
| S16 | | | | | **7310.5** | **9138.1** | empty | | 7310.5 | **3000** | **2400** |
| S17 | | | | | | | | | gas+RFoff, ions pulsed into oa-tof, gas+RF on | | |

FIG. 4

MASS SPECTROMETER

CROSS-REFERENCE TO RELATED APPLICATIONS

This application claims the benefit of the filing of U.S. Provisional Patent Application Ser. No. 60/422,088, filed Oct. 30, 2002.

BACKGROUND OF THE INVENTION

1. Field of the Invention

The present invention relates to a mass spectrometer and a method of mass spectrometry. The preferred embodiment relates to 3D quadrupole ion traps ("QIT") and Time of Flight ("TOF") mass analysers.

2. Discussion of the Prior Art

Known 3D (Paul) quadrupole ion trap mass spectrometers comprise a doughnut shaped central ring electrode and two end-cap electrodes. Such known 3D (Paul) quadrupole ion trap mass spectrometers typically have a relatively low resolution and a relatively low mass measurement accuracy when scanning the complete mass range compared with other types of mass spectrometers such as magnetic sector and Time of Flight mass spectrometers. 3D quadrupole ion traps do however exhibit a relatively high sensitivity in both MS and MS/MS modes of operation. One particular problem with 3D quadrupole ion traps is that they suffer from having a relatively limited mass range and exhibit a low mass to charge ratio cut-off limit below which ions cannot be stored within the quadrupole ion trap. In a MS/MS mode of operation only about a 3:1 ratio of parent mass to fragment mass can be stored and recorded.

Orthogonal acceleration Time of Flight mass spectrometers have relatively higher resolving powers and higher mass measurement accuracy for both MS and MS/MS modes. Typically, orthogonal acceleration Time of Flight mass spectrometers are coupled to ion sources which provide a continuous beam of ions. Segments of this continuous ion beam are then orthogonally extracted for subsequent mass analysis. However, about 75% of the ions are not extracted for mass analysis and are thus lost.

It is therefore desired to address the mass range limitation inherent with conventional quadrupole ion traps and to increase the duty cycle of an orthogonal acceleration Time of Flight mass analyser when performing MS and MS/MS experiments.

SUMMARY OF THE INVENTION

According to the present invention there is provided a mass spectrometer comprising:

a first ion trap and a second ion trap wherein the first ion trap is arranged to have, in use, a first low mass cut-off and the second ion trap is arranged to have, in use, a second low mass cut-off, the second low mass cut-off being lower than the first low mass cut-off so that at least some ions having mass to charge ratios lower than the first low mass cut-off which are not trapped in the first ion trap are trapped in the second ion trap.

Advantageously, the combination of two or more ion traps in series having different low mass cut-offs increases the overall ion trapping volume or capacity and hence the dynamic range of the ion trapping system.

A mass spectrometer according to the preferred embodiment is capable of performing both MS and MS/MS modes of operation and comprises an ion source, a series of coupled quadrupole ion traps and an orthogonal acceleration Time of Flight mass analyser. The combination of multiple quadrupole ion traps and the orthogonal acceleration Time of Flight mass analyser provides a mass spectrometer with an increased mass range (especially in MS/MS), increased sensitivity, increased mass measurement accuracy and increased mass resolution compared with other known arrangements.

According to a less preferred embodiment fragment ions may be generated externally to the first ion trap by surface induced disassociation (SID), collision induced disassociation (CID) or post source decay (PSD) and then transferred to the first ion trap.

According to the preferred embodiment collisional cooling with a bath gas may be employed in one or more of the ion traps and/or in the transfer region(s) between the ion traps. Collisional cooling advantageously reduces both the kinetic energy of the ions and the spread of kinetic energies of the ions. Collisional cooling also has the effect of improving the trapping efficiency within the ion trap whilst preparing the ions for subsequent mass analysis in a Time of Flight mass analyser, preferably an orthogonal acceleration Time of Flight mass analyser, which may optionally include a reflectron.

The first ion trap preferably comprises a quadrupole ion trap. According to the one embodiment the first ion trap comprises a 3D (Paul) quadrupole ion trap comprising a ring electrode and two end-cap electrodes, the ring electrode and the end-cap electrodes having a hyperbolic surface.

According to another embodiment the first ion trap comprises one or more cylindrical ring electrodes and two substantially planar end-cap electrodes.

According to another embodiment the first ion trap comprises one, two, three or more than three ring electrodes and two substantially planar end-cap electrodes.

One of the end-cap electrodes may comprise a sample or target plate. The sample or target plate may comprise a substrate with a plurality of sample regions arranged preferably in a microtitre format wherein, for example, the pitch spacing between samples is approximately or exactly 18 mm, 9 mm, 4.5 mm, 2.25 mm or 1.125 mm. Up to or at least 48, 96, 384, 1536 or 6144 samples may be arranged to be received on the sample or target plate. A laser beam or an electron beam is preferably targeted in use at the sample or target plate.

One of the end-cap electrodes of the first ion trap may comprise a mesh or grid.

The first ion trap may comprise a 2D (linear) quadrupole ion trap comprising a plurality of rod electrodes and two end electrodes.

According to other less preferred embodiments the first ion trap may comprise a segmented ring set comprising a plurality of electrodes having apertures through which ions are transmitted or a Penning ion trap.

A first AC or RF voltage having a first amplitude is preferably applied to the first ion trap. The first amplitude is preferably selected from the group consisting of: (i) 0–250 $V_{pp}$; (ii) 250–500 $V_{pp}$; (iii) 500–750 $V_{pp}$; (iv) 750–1000 $V_{pp}$; (v) 1000–1250 $V_{pp}$; (vi) 1250–1500 $V_{pp}$; (vii) 1500–1750 $V_{pp}$; (viii) 1750–2000 $V_{pp}$; (ix) 2000–2250 $V_{pp}$; (x) 2250–2500 $V_{pp}$; (xi) 2500–2750 $V_{pp}$; (xii) 2750–3000 $V_{pp}$; (xiii) 3000–3250 $V_{pp}$; (xiv) 3250–3500 $V_{pp}$; (xv) 3500–3750 $V_{pp}$; (xvi) 3750–4000 $V_{pp}$; (xvii) 4000–4250 $V_{pp}$; (xviii) 4250–4500 $V_{pp}$; (xix) 4500–4750 $V_{pp}$; (xx) 4750–5000 $V_{pp}$; (xxi) 5000–5250 $V_{pp}$; (xxii) 5250–5500 $V_{pp}$; (xxiii) 5500–5750 $V_{pp}$; (xxiv) 5750–6000 $V_{pp}$; (xxv) 6000–6250 $V_{pp}$; (xxvi) 6250–6500 $V_{pp}$; (xxvii) 6500–6750

$V_{pp}$; (xxviii) 6750–7000 $V_{pp}$; (xxix) 7000–7250 $V_{pp}$; (xxx) 7250–7500 $V_{pp}$; (xxxi) 7500–7750 $V_{pp}$; (xxxii) 7750–8000 $V_{pp}$; (xxxiii) 8000–8250 $V_{pp}$; (xxxiv) 8250–8500 $V_{pp}$; (xxxv) 8500–8750 $V_{pp}$; (xxxvi) 8750–9000 $V_{pp}$; (xxxvii) 9250–9500 $V_{pp}$; (xxxviii) 9500–9750 $V_{pp}$; (xxxix) 9750–10000 $V_{pp}$; and (xl) >10000 $V_{pp}$.

The first AC or RP voltage preferably has a frequency within a range selected from the group consisting of: (i) <100 kHz; (ii) 100–200 kHz; (iii) 200–400 kHz; (iv) 400–600 kHz; (v) 600–800 kHz; (vi) 800–1000 kHz; (vii) 1.0–1.2 MHz; (viii) 1.2–1.4 MHz; (ix) 1.4–1.6 MHz; (x) 1.6–1.8 MHz; (xi) 1.8–2.0 MHz; and (xii) >2.0 MHz.

The second ion trap preferably comprises a quadrupole ion trap.

The second ion trap may comprise a 3D (Paul) quadrupole ion trap comprising a ring electrode and two end-cap electrodes, the ring electrode and the end-cap electrodes having a hyperbolic surface. Alternatively, the second ion trap may comprise a cylindrical ring electrode and two substantially planar end-cap electrodes.

The second ion trap may comprise one, two, three or more than three ring electrodes and two substantially planar end-cap electrodes. One or more of the end-cap electrodes of the second ion trap may comprise a mesh or grid.

According to another embodiment the second ion trap may comprise a 2D (linear) quadrupole ion trap comprising a plurality of rod electrodes and two end electrodes.

According to less preferred embodiments the second ion trap may comprise a segmented ring set comprising a plurality of electrodes having apertures through which ions are transmitted or a Penning ion trap.

A second AC or RF voltage having a second amplitude is preferably applied to the second ion trap. The second amplitude is preferably selected from the group consisting of: (i) 0–250 $V_{pp}$; (ii) 250–500 $V_{pp}$; (iii) 500–750 $V_{pp}$; (iv) 750–1000 $V_{pp}$; (v) 1000–1250 $V_{pp}$; (vi) 1250–1500 $V_{pp}$; (vii) 1500–1750 $V_{pp}$; (viii) 1750–2000 $V_{pp}$; (ix) 2000–2250 $V_{pp}$; (x) 2250–2500 $V_{pp}$; (xi) 2500–2750 $V_{pp}$; (xii) 2750–3000 $V_{pp}$; (xiii) 3000–3250 $V_{pp}$; (xiv) 3250-3500 $V_{pp}$; (xv) 3500–3750 $V_{pp}$; (xvi) 3750–4000 $V_{pp}$: (xvii) 4000–4250 $V_{pp}$; (xviii) 4250–4500 $V_{pp}$; (xix) 4500–4750 $V_{pp}$; (xx) 4750–5000 $V_{pp}$; (xxi) 5000–5250 $V_{pp}$; (xxii) 5250–5500 $V_{pp}$; (xxiii) 5500–5750 $V_{pp}$; (xxiv) 5750–6000 $V_{pp}$; (xxv) 6000–6250 $V_{pp}$; (xxvi) 6250–6500 $V_{pp}$; (xxvii) 6500–6750 $V_{pp}$; (xxviii) 6750–7000 $V_{pp}$; (xxix) 7000–7250 $V_{pp}$; (xxx) 7250–7500 $V_{pp}$; (xxxi) 7500–7750 $V_{pp}$; (xxxii) 7750–8000 $V_{pp}$; (xxxiii) 8000–8250 $V_{pp}$; (xxxiv) 8250–8500 $V_{pp}$; (xxxv) 8500–8750 $V_{pp}$; (xxxvi) 8750–9000 $V_{pp}$; (xxxvii) 9250–9500 $V_{pp}$; (xxxviii) 9500–9750 $V_{pp}$; (xxxix) 9750–10000 $V_{pp}$; and (xl) >10000 $V_{pp}$.

The second AC or RF voltage preferably has a frequency within a range selected from the group consisting of: (i) <100 kHz; (ii) 100–200 kHz; (iii) 200–400 kHz: (iv) 400–600 kHz; (v) 600–800 kHz; (vi) 800–1000 kHz; (vii) 1.0–1.2 MHz; (viii) 1.2–1.4 MHz; (ix) 1.4–1.6 MHz; (x) 1.6–1.8 MHz: (xi) 1.8–2.0 MHz; and (xii) >2.0 MHz.

The amplitude of an AC or RF voltage applied to the first ion trap is preferably greater than the amplitude of an AC or RF voltage applied to the second ion trap.

The amplitude of an AC or RF voltage applied to the first ion trap is preferably greater than the amplitude of an AC or RF voltage applied to the second ion trap by at least x $V_{pp}$ and wherein x is selected from the group consisting of: (i) 5; (ii) 10; (iii) 20; (iv) 30; (v) 40: (vi) 50; (vii) 60; (viii) 70; (ix) 80; (x) 90; (xi) 100; (Xii) 110; (xiii) 120; (xiv) 130; (xv) 140; (xvi) 150; (xvii) 160; (xviii) 170; (xix) 180; (xx) 190; (xxi) 200; (xxii) 250; (xxiii) 300; (xxiv) 350; (xxv) 400; (xxvi) 450; (xxvii) 500; (xxviii) 550; (xxix) 600; (xxx) 650; (xxxi) 700; (xxxii) 750; (xxxiii) 800; (xxxiv) 850; (xxxv) 900; (xxxvi) 950; and (xxxvii) 1000.

The first ion trap and/or the second ion trap are preferably maintained at a pressure selected from the group consisting of; (i) greater than or equal to 0.0001 mbar; (ii) greater than or equal to 0.0005 mbar; (iii) greater than or equal to 0.001 mbar; (iv) greater than or equal to 0.005 mbar; (v) greater than or equal to 0.01 mbar; (vi) greater than or equal to 0.05 mbar; (vii) greater than or equal to 0.1 mbar; (viii) greater than or equal to 0.5 mbar: (ix) greater than or equal to 1 mbar; (x) greater than or equal to 5 mbar; and (xi) greater than or equal to 10 mbar.

The first ion trap and/or the second ion trap are preferably maintained at a pressure selected from the group consisting of: (i) less than or equal to 10 mbar; (ii) less than or equal to 5 mbar; (iii) less than or equal to 1 mbar; (iv) less than or equal to 0.5 mbar; (v) less than or equal to 0.1 mbar; (vi) less than or equal to 0.05 mbar; (vii) less than or equal to 0.01 mbar; (viii) less than or equal to 0.005 mbar; (ix) less than or equal to 0.001 mbar: (x) less than or equal to 0.0005 mbar; and (xi) less than or equal to 0.0001 mbar.

The first ion trap and/or the second ion trap are preferably maintained, in use, at a pressure selected from the group consisting of: (i) between 0.0001 and 10 mbar; (ii) between 0.0001 and 1 mbar; (iii) between 0.0001 and 0.1 mbar; (iv) between 0.0001 and 0.01 mbar; (v) between 0.0001 and 0.001 mbar; (vi) between 0.001 and 10 mbar; (vii) between 0.001 and 1 mbar; (viii) between 0.001 and 0.1 mbar; (ix) between 0.001 and 0.01 mbar; (x) between 0.01 and 10 mbar; (xi) between 0.01 and 1 mbar; (xii) between 0.01 and 0.1 mbar; (xiii) between 0.1 and 10 mbar; (xiv) between 0.1 and 1 mbar; and (xv) between 1 and 10 mbar.

According to other embodiments further ion traps may be provided in series with the first and second ion traps. Accordingly, a third ion trap may be provided and which is arranged to have, in use, a third low mass cut-off, the third low mass cut-off being lower than the second low mass cut-off so that at least some ions having mass to charge ratios lower than the first and second mass cut-offs which are not trapped in the first and second ion traps are trapped in the third ion trap.

A third AC or RF voltage having a third amplitude may be applied to the third ion trap. The third amplitude is preferably selected from the group consisting of: (i) 0–250 $V_{pp}$; (ii) 250–500 $V_{pp}$; (iii) 500–750 $V_{pp}$; (iv) 750–1000 $V_{pp}$; (v) 1000–1250 $V_{pp}$; (vi) 1250–1500 $V_{pp}$; (vii) 1500–1750 $V_{pp}$; (viii) 1750–2000 $V_{pp}$; (ix) 2000–2250 $V_{pp}$; (x) 2250–2500 $V_{pp}$; (xi) 2500–2750 $V_{pp}$; (xii) 2750–3000 $V_{pp}$; (xiii) 3000–3250 $V_{pp}$; (xiv) 3250–3500 $V_{pp}$; (xv) 3500–3750 $V_{pp}$; (xvi) 3750–4000 $V_{pp}$; (xvii) 4000–4250 $V_{pp}$; (xviii) 4250–4500 $V_{pp}$; (xix) 4500–4750 $V_{pp}$; (xx) 4750–5000 $V_{pp}$; (xxi) 5000–5250 $V_{pp}$; (xxii) 5250–5500 $V_{pp}$; (xxiii) 5500–5750 $V_{pp}$; (xxiv) 5750–6000 $V_{pp}$; (xxv) 6000–6250 $V_{pp}$; (xxvi) 6250–6500 $V_{pp}$; (xxvii) 6500–6750 $V_{pp}$; (xxviii) 6750–7000 $V_{pp}$; (xxix) 7000–7250 $V_{pp}$; (xxx) 7250–7500 $V_{pp}$; (xxxi) 7500–7750 $V_{pp}$; (xxxii) 7750–8000 $V_{pp}$; (xxxiii) 8000–8250 $V_{pp}$; (xxxiv) 8250–8500 $V_{pp}$; (xxxv) 8500–8750 $V_{pp}$; (xxxvi) 8750–9000 $V_{pp}$; (xxxvii) 9250–9500 $V_{pp}$; (xxxviii) 9500–9750 $V_{pp}$; (xxxix) 9750–10000 $V_{pp}$; and (xl) >10000 $V_{pp}$.

The third AC or RP voltage preferably has a frequency within a range selected from the group consisting of: (i) <100 kHz; (ii) 100–200 kHz; (iii) 200–400 kHz; (iv) 400–600 kHz: (v) 600–800 kHz; (vi) 800–1000 kHz; (vii) 1.0–1.2 MHz; (viii) 1.2–1.4 MHz; (ix) 1.4–1.6 MHz; (x) 1.6–1.8 MHz; (xi) 1.8–2.0 MHz; and (xii) >2.0 MHz.

The amplitude of an AC or RF voltage applied to the second ion trap is preferably greater than the third amplitude.

A fourth ion trap may be provided and which is preferably arranged to have, in use, a fourth low mass cut-off, the fourth low mass cut-off being lower than the third low mass cut-off so that at least some ions having mass to charge ratios lower than the first, second and third mass cut-offs which are not trapped in the first, second and third ion traps are trapped in the fourth ion trap.

A fourth AC or RF voltage having a fourth amplitude is preferably applied to the fourth ion trap. The fourth amplitude is preferably selected from the group consisting of: (i) 0–250 $V_{pp}$; (ii) 250–500 $V_{pp}$; (iii) 500–750 $V_{pp}$; (iv) 750–1000 $V_{pp}$; (v) 1000–1250 $V_{pp}$; (vi) 1250–1500 $V_{pp}$; (vii) 1500–1750 $V_{pp}$; (viii) 1750–2000 $V_{pp}$; (ix) 2000–2250 $V_{pp}$; (x) 2250–2500 $V_{pp}$; (xi) 2500–2750 $V_{pp}$; (xii) 2750–3000 $V_{pp}$; (xiii) 3000–3250 $V_{pp}$; (xiv) 3250–3500 $V_{pp}$; (xv) 3500–3750 $V_{pp}$; (xvi) 3750–4000 $V_{pp}$; (xvii) 4000–4250 $V_{pp}$; (xviii) 4250–4500 $V_{pp}$; (xix) 4500–4750 $V_{pp}$; (xx) 4750–5000 $V_{pp}$; (xxi) 5000–5250 $V_{pp}$; (xxii) 5250–5500 $V_{pp}$; (xxiii) 5500–5750 $V_{pp}$; (xxiv) 5750–6000 $V_{pp}$; (xxv) 6000–6250 $V_{pp}$; (xxvi) 6250–6500 $V_{pp}$; (xxvii) 6500–6750 $V_{pp}$; (xxviii) 6750–7000 $V_{pp}$; (xxix) 7000–7250 $V_{pp}$; (xxx) 7250–7500 $V_{pp}$; (xxxi) 7500–7750 $V_{pp}$; (xxxii) 7750–8000 $V_{pp}$; (xxxiii) 8000–8250 $V_{pp}$; (xxxiv) 8250–8500 $V_{pp}$; (xxxv) 8500–8750 $V_{pp}$; (xxxvi) 8750–9000 $V_{pp}$; (xxxvii) 9250–9500 $V_{pp}$; (xxxviii) 9500–9750 $V_{pp}$; (xxxix) 9750–10000 $V_{pp}$; and (xl) >10000 $V_{pp}$.

The fourth AC or RF voltage preferably has a frequency within a range selected from the group consisting of: (i) <100 kHz; (ii) 100–200 kHz; (iii) 200–400 kHz; (iv) 400–600 kHz; (v) 600–800 kHz; (vi) 800–1000 kHz; (vii) 1.0–1.2 MHz; (viii) 1.2–1.4 MHz; (ix) 1.4–1.6 MHz; (x) 1.6–1.8 MHz; (xi) 1.8–2.0 MHz; and (xii) >2.0 MHz.

The third amplitude is preferably greater than the fourth amplitude.

According to other embodiments five, six, seven, eight, nine, ten or more than ten ion traps may be provided in series.

A continuous or pulsed ion source is preferably provided. The ion source may comprise an Electrospray ion source, an Atmospheric Pressure Chemical Ionisation ("APCI") ion source, an Atmospheric Pressure MALDI ion source, an Electron Ionisation ("EI") ion source, a Chemical Ionisation ("CI") ion source, a Field Desorption Ionisation ("FI") ion source, a Matrix Assisted Laser Desorption Ionisation ("MALDI") ion source, a Laser Desorption Ionisation ("LDI") ion source, a Laser Desorption/Ionization on Silicon ("DIOS") ion source, a Surface Enhanced Laser Desorption Ionisation ("SELDI") ion source or a Fast Atom Bombardment ("FAB") ion source.

An ion detector may be arranged downstream of the second ion trap. The ion detector may comprise an electron multiplier, a photo-multiplier or a channeltron.

A Time of Flight mass analyser, such as an axial Time of Flight mass analyser or more preferably an orthogonal acceleration Time of Flight mass analyser may be provided.

In addition to the first, second and optionally third, fourth etc. ion traps, a further ion trap is preferably provided. The further ion trap preferably comprises a quadrupole ion trap.

The further ion trap may comprise a 3D (Paul) quadrupole ion trap comprising a ring electrode and two end-cap electrodes, the ring electrode and the end-cap electrodes having a hyperbolic surface.

The further ion trap may comprise one or more cylindrical ring electrodes and two substantially planar end-cap electrodes.

Alternatively, the further ion trap may comprise one, two, three or more than three ring electrodes and two substantially planar end-cap electrodes.

According to an embodiment one or more of the end-cap electrodes of the further ion trap may comprise a mesh or grid.

According to another embodiment the further ion trap may comprise a 2D (linear) quadrupole ion trap comprising a plurality of rod electrodes and two end electrodes.

According to less preferred embodiments the further ion trap may comprise a segmented ring set comprising a plurality of electrodes having apertures through which ions are transmitted or a Penning ion trap.

Ions are preferably pulsed out of the further ion trap in a non mass-selective mode or non scanning mode. For example, ions may be pulsed out of the further ion trap by applying a DC voltage extraction pulse to the end-cap electrodes of the further ion trap. A DC voltage may also or alternatively be applied to the ring electrode(s) of the further ion trap so that a more linear axial DC electric field gradient is provided.

Additional ion traps may be provided for storing parent ions in MS/MS modes of operation. The mass spectrometer may therefore further comprise a first additional ion trap. The first additional ion trap preferably comprises a quadrupole ion trap. The first additional ion trap may comprise a 3D (Paul) quadrupole ion trap comprising a ring electrode and two end-cap electrodes, the ring electrode and the end-cap electrodes having a hyperbolic surface.

Alternatively, the first additional ion trap may comprise one or more cylindrical ring electrodes and two substantially planar end-cap electrodes.

The first additional ion trap may comprise one, two, three or more than three ring electrodes and two substantially planar end-cap electrodes. One or more end-cap electrodes of the first additional ion trap may comprise a mesh or grid.

The first additional ion trap may comprise a 2D (linear) quadrupole ion trap comprising a plurality of rod electrodes and two end electrodes. Alternatively, the first additional ion trap may comprise a segmented ring set comprising a plurality of electrodes having apertures through which ions are transmitted or a Penning ion trap.

A second additional ion trap for storing parent ions in MS/MS modes of operation may preferably be provided. The second additional ion trap may comprise a quadrupole ion trap. The second additional ion trap may comprise a 3D (Paul) quadrupole ion trap comprising a ring electrode and two end-cap electrodes, the ring electrode and the end-cap electrodes having a hyperbolic surface.

The second additional ion trap may comprise one or more cylindrical ring electrodes and two substantially planar end-cap electrodes. Alternatively, the second additional ion trap may comprise one, two, three or more than three ring electrodes and two substantially planar end-cap electrodes. One or more end-cap electrode of the second additional ion trap may comprise a mesh or grid.

The second additional ion trap may comprise a 2D (linear) quadrupole ion trap comprising a plurality of rod electrodes and two end electrodes. Alternatively, the second additional ion trap may comprise a segmented ring set comprising a plurality of electrodes having apertures through which ions are transmitted or a Penning ion trap.

According to another aspect of the present invention, there is provided a method of mass spectrometry, comprising:

providing a first ion trap having a first low mass cut-off;

providing a second ion trap having a second low mass cut-off, the second low mass cut-off being lower than the first low mass cut-off;

trapping some ions in the first ion trap; and trapping in the second ion trap at least some ions having mass to charge ratios lower than the first low mass cut-off which are not trapped in the first ion trap.

In the various embodiments contemplated in the present application when a quadrupole ion trap is used with multiple inner (or ring) electrodes (which are simpler to manufacture than electrodes having an hyperbolic surface) the quadrupole field may be generated by applying different AC or RF voltage amplitudes of the same phase to each inner electrode. The inner electrodes should preferably be symmetrical about the centre of the ion trap. However, by selecting a certain aperture or inner radius for the ring electrodes it is possible to generate an AC or RF electric field which is close to quadrupolar with the same amplitude and phase of AC or RF applied to each ring electrode and with the opposing phase applied to the end-cap electrodes.

If an ion trap with e.g. flat or thin cylindrical electrodes has to pulse ions out of the ion trap (for example, to pulse the ions into an axial or orthogonal acceleration Time of Flight mass analyser) then the DC voltages applied to the electrodes in such an ion extraction mode can be arranged so that a substantially linear electric field is generated. This may be advantageous in terms of ion transfer efficiency. Also, there may be some degree of time of flight spatial focusing after pulsed extraction.

According to another aspect of the present invention there is provided a mass spectrometer comprising:

a quadrupole ion trap;

a further ion trap arranged to receive ions ejected from the quadrupole ion trap; and a Time of Flight mass analyser arranged to receive ions ejected from the further ion trap;

wherein in a first mode of operation the further ion trap receives a pulse of ions which have been mass-selectively ejected from or scanned out of the quadrupole ion trap, wherein the ratio of the maximum mass to charge ratio of ions in the pulse of ions to the minimum mass to charge ratio of ions in the pulse of ions is a maximum of x, and wherein $x \leqq 4.0$, and wherein the ions received from the quadrupole ion trap are collisionally cooled within the further ion trap.

Preferably, x is selected from the group consisting of: (i.) 3.9; (ii) 3.8; (iii) 3.7; (iv) 3.6; (v) 3.5; (vi) 3.4; (vii) 3.3; (viii) 3.2; (ix) 3.1; (x) 3.0; (xi) 2.9: (xii) 2.8; (xiii) 2.7; (xiv) 2.6; (xv) 2.5; (xvi) 2.4; (xvii) 2.3; (xviii) 2.2; (xix) 2.1; (xx) 2.0; (xxi) 1.9; (xxii) 1.8; (xxiii) 1.7; (xxiv) 1.6; (xxv) 1.5; (xxvi) 1.4; (xxvii) 1.3; (xxviii) 1.2; and (xxix) 1.1.

In a first mode of operation the further ion trap is preferably maintained at a pressure selected from the group consisting of: (i) greater than or equal to 0.0001 mbar; (ii) greater than or equal to 0.0005 mbar; (iii) greater than or equal to 0.001 mbar; (iv) greater than or equal to 0.005 mbar; (v) greater than or equal to 0.01 mbar; (vi) greater than or equal to 0.05 mbar; (vii) greater than or equal to 0.1 mbar; (viii) greater than or equal to 0.5 mbar; (ix) greater than or equal to 1 mbar; (x) greater than or equal to 5 mbar; and (xi) greater than or equal to 10 mbar.

In a first mode of operation the further ion trap is preferably maintained at a pressure selected from the group consisting of: (i) less than or equal to 10 mbar; (ii) less than or equal to 5 mbar; (iii) less than or equal to 1 mbar; (iv) less than or equal to 0.5 mbar; (v) less than or equal to 0.1 mbar; (vi) less than or equal to 0.05 mbar; (vii) less than or equal to 0.01 mbar: (viii) less than or equal to 0.005 mbar; (ix) less than or equal to 0.001 mbar; (x) less than or equal to 0.0005 mbar; and (xi) less than or equal to 0.0001 mbar.

In a first mode of operation the further ion trap is preferably maintained at a pressure selected from the group consisting of: (i) between 0.0001 and 10 mbar; (ii) between 0.0001 and 1 mbar; (iii) between 0.0001 and 0.1 mbar; (iv) between 0.0001 and 0.01 mbar; (v) between 0.0001 and 0.001 mbar; (vi) between 0.001 and 10 mbar; (vii) between 0.001 and 1 mbar; (viii) between 0.001 and 0.1 mbar; (ix) between 0.001 and 0.01 mbar: (x) between 0.01 and 10 mbar; (xi) between 0.01 and 1 mbar; (xii) between 0.01 and 0.1 mbar; (xiii) between 0.1 and 10 mbar; (xiv) between 0.1 and 1 mbar; and (xv) between 1 and 10 mbar.

In a second mode of operation ions are preferably pulsed out of or ejected from the further ion trap in a non mass-selective or a non-scanning manner i.e. ions are not resonantly excited out of the further ion trap and hence the ions are not ejected from the further ion trap in a substantially excited state. In the second mode of operation ions may be pulsed out of or ejected from the further ion trap by applying one or more DC voltage extraction pulses to the further ion trap. The one or more DC extraction voltages may also be applied to one or more end or end-cap electrodes of the further ion trap and/or to one or more central or ring electrodes of the further ion trap. Preferably, in the second mode of operation AC or RF voltages are not substantially applied to the electrodes of the further ion trap.

In the second mode of operation the further ion trap is preferably maintained at a lower pressure than when the further ion trap is operated in the first mode of operation. The further ion trap is preferably maintained at a pressure selected from the following group when operated in the second mode of operation; (i) $<5\times10^{-2}$ mbar; (ii) $<10^{-2}$ mbar; (iii) $<5\times10^{-3}$ mbar; (iv) $<10^{-3}$ mbar; (v) $<5\times10^{-4}$ mbar; (vi) $<10^{-4}$ mbar; (vii) $<5\times10^{-5}$ mbar; (viii) $<10^{-5}$ mbar; (ix) $<5\times10^{-6}$ mbar; and (x) $<10^{-6}$ mbar.

In the first mode of operation a pulse of ions ejected from the quadrupole ion trap and received by the further ion trap preferably has a first range of energies $\Delta E_1$ and wherein in the second mode of operation ions ejected from the further ion trap preferably have a second range of energies $\Delta E_2$, wherein $\Delta E_2<\Delta E_1$. $\Delta E_1/\Delta E_2$ is preferably at least 5, 10, 15, 20, 25, 30, 35, 40, 45, 50, 55, 60, 65, 70, 75, 80, 85, 90, 95 or 100. $\Delta E_1$ is preferably at least 1, 2, 3, 4, 5, 6, 7, 8, 9 or 10 eV and $\Delta E_2$ is preferably a maximum of 1, 0.9, 0.8, 0.7, 0.6, 0.5, 0.4, 0.3, 0.2, 0.1, 0.09, 0.08, 0.07, 0.06, 0.05, 0.04, 0.03, 0.02 or 0.01 eV.

According to another aspect of the present invention there is provided a method of mass spectrometry, comprising:

providing a quadrupole ion trap, a further ion trap arranged to receive ions ejected from the quadrupole ion trap and a Time of Flight mass analyser arranged to receive ions ejected from the further ion trap;

mass-selectively ejecting from or scanning out of the quadrupole ion trap a pulse of ions in a first mode of operation wherein the further ion trap receives the pulse of ions and wherein the ratio of the maximum mass to charge ratio of ions in the pulse of ions to the minimum mass to charge ratio of ions in the pulse of ions is a maximum of x, and wherein $x \leqq 4.0$; and collisionally cooling the ions received from the quadrupole ion trap within the further ion trap.

According to another aspect of the present invention there is provided a method of mass spectrometry comprising;

storing parent ions having a first mass to charge ratio in a first ion trap;

storing at least some other parent ions having mass to charge ratios other than the first mass to charge ratio in one or more additional ion traps;

fragmenting the parent ions having the first mass to charge ratio in the first ion trap so as to form fragment ions;

trapping some of the fragment ions in the first ion trap having a first low mass cut-off; and trapping other of the fragment ions in a second ion trap having a second low mass cut-off, wherein the second low mass cut-off is lower than the first low mass cut-off.

According to another aspect of the present invention, there is provided a method of mass spectrometry comprising:

storing parent ions having a first mass to charge ratio in an ion trap;

storing at least some other parent ions having mass to charge ratios other than the first mass to charge ratio in one or more additional ion traps;

fragmenting the parent ions having the first mass to charge ratio in a first ion trap so as to form fragment ions;

trapping some of the fragment ions in the first ion trap having a first low mass cut-off; and trapping other of the fragment ions in a second ion trap having a second low mass cut-off, wherein the second low mass cut-off is lower than the first low mass cut-off.

According to another aspect of the present invention, there is provided a method of mass spectrometry comprising:

storing parent ions having a first mass to charge ratio in an ion trap;

storing at least some other parent ions having mass to charge ratios other than the first mass to charge ratio in one or more additional ion traps;

fragmenting the parent ions having the first mass to charge ratio so as to form fragment ions;

trapping some of the fragment ions in a first ion trap having a first low mass cut-off; and trapping other of the fragment ions in a second ion trap having a second low mass cut-off, wherein the second low mass cut-off is lower than the first low mass cut-off.

The ion trap may be the same as the first ion trap.

Fragment ions are preferably collisionally cooled within the first and/or second ion traps. Some fragment ions are preferably scanned out of or mass-selectively ejected out of the first and/or second ion traps whilst retaining other fragment ions within the first and/or second ion traps.

In a first mode of operation at least some fragment ions which have been scanned out of or mass-selectively ejected from either the first ion trap and/or the second ion trap may be received, trapped and collisionally cooled in a further ion trap.

A pulse of ions ejected from or pulsed out of the further ion trap in a second mode of operation is preferably received by a Time of Flight mass analyser e.g. an axial or orthogonal acceleration Time of Flight mass analyser.

According to another aspect of the present invention, there is provided a mass spectrometer comprising:

a first ion trap wherein in use parent ions having a first mass to charge ratio are stored therein;

one or more additional ion traps wherein in use at least some other parent ions having mass to charge ratios other than the first mass to charge ratio are stored therein; and a second ion trap;

wherein in use the parent ions having the first mass to charge ratio are fragmented in the first ion trap so as to form fragment ions and wherein some of the fragment ions are trapped in the first ion trap having a first low mass cut-off and other of the fragment ions are trapped in the second ion trap having a second low mass cut-off, wherein the second low mass cut-off is lower than the first low mass cut-off.

According to another aspect of the present invention there is provided a mass spectrometer comprising:

an ion trap wherein in use parent ions having a first mass to charge ratio are stored therein;

one or more additional ion traps wherein in use at least some other parent ions having mass to charge ratios other than the first mass to charge ratio are stored therein;

a first ion trap; and a second ion trap;

wherein in use the parent ions having the first mass to charge ratio are fragmented in the first ion trap so as to form fragment ions and wherein some of the fragment ions are trapped in the first ion trap having a first low mass cut-off and other of the fragment ions are trapped in a second ion trap having a second low mass cut-off, wherein the second low mass cut-off is lower than the first low mass cut-off.

According to another aspect of the present invention there is provided a mass spectrometer comprising:

an ion trap wherein in use parent ions having a first mass to charge ratio are stored therein;

one or more additional ion traps wherein in use at least some other parent ions having mass to charge ratios other than the first mass to charge ratio are stored therein;

a first ion trap; and a second ion trap;

wherein in use the parent ions having the first mass to charge ratio are fragmented so as to form fragment ions and wherein some of the fragment ions are trapped in the first ion trap having a first low mass cut-off and wherein other of the fragment ions are trapped in a second ion trap having a second low mass cut-off, wherein the second low mass cut-off is lower than the first low mass cut-off.

According to another aspect of the present invention there is provided a mass spectrometer comprising:

a first ion trap, the first ion trap comprising an ion trap ion source comprising one or more central electrodes, a first end-cap electrode and a second end-cap electrode;

wherein a sample or target plate forms at least part of the first end-cap electrode of the first ion trap.

The ion trap ion source may comprise a Matrix Assisted Laser Desorption Ionisation ("MALDI") ion trap ion source, a Laser Desorption Ionisation ("LDI") ion trap ion source, a Laser Desorption/Ionization on Silicon ("DIOS") ion trap ion source, a Surface Enhanced Laser Desorption Ionisation ("SELDI") ion trap ion source or a Fast Atom Bombardment ("FAB") ion trap ion source.

According to another aspect of the present invention there is provided a method of mass spectrometry comprising:

providing a first ion trap, the first ion trap comprising an ion trap ion source comprising one or more central electrodes, a first end-cap electrode and a second end-cap electrode wherein a sample or target plate forms at least part of the first end-cap electrode;

arranging for a laser beam or an electron beam to impinge upon the sample or target plate; and ionising samples or targets on the sample or target plate.

BRIEF DESCRIPTION OF THE DRAWINGS

Various embodiments of the present invention will now be described, by way of example only, and with reference to the accompanying drawings in which:

FIG. 4 shows a table illustrating the various stages which may be performed in mass analysing ions having mass to charge ratios within the range 100–3000 mass to charge ratio units according to an embodiment of the present invention;

DETAILED DESCRIPTION OF THE PREFERRED EMBODIMENTS

Figure 1:
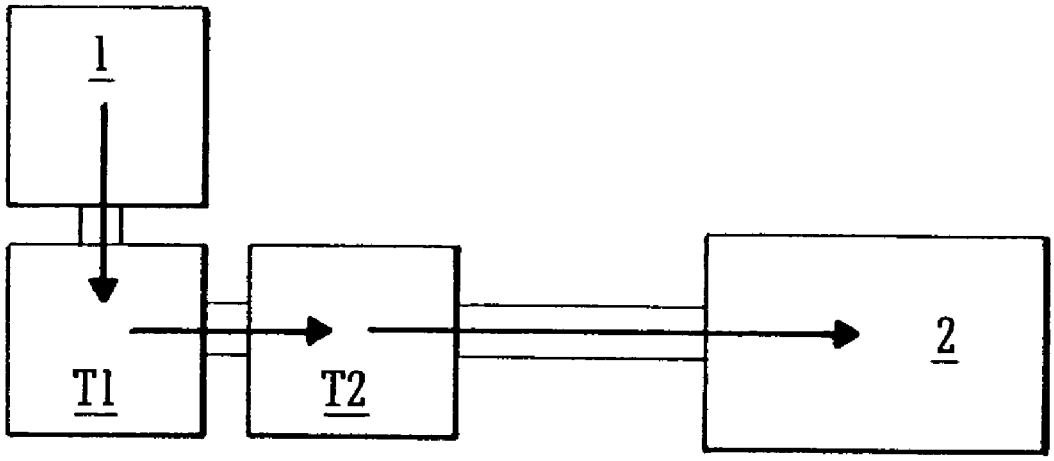
FIG. 1 shows an ion trapping system according to an embodiment comprising two ion traps arranged in series and having different low mass cut-offs so that ions not trapped in the first ion trap are trapped in the second ion trap.

A preferred embodiment of the present invention will now be described with reference to FIG. 1. FIG. 1 shows an embodiment wherein two ion traps T1,T2, for example 3D (Paul) quadrupole ion traps, are arranged in series to provide an ion trapping system having an improved overall mass range. The ion trapping system is arranged to receive ions from an ion source 1. However, the ions may not necessarily be generated externally to the first ion trap T1 and according to another embodiment described in more detail later, ions may be generated or formed within the first ion trap T1.

If ions are generated externally to the first ion trap T1 then they are preferably transferred from the ion source 1 into the first ion trap T1 using inhomogeneous RF confining fields. For example, an RF ion guide may be provided and an axial DC electric field gradient and/or travelling DC voltages or voltage waveforms (i.e. wherein axial trapping regions are translated along the length of an ion guide) may be applied to the RF ion guide in order to urge ions into the first ion trap T1. Ions may also be transferred from one ion trap to the other in a similar manner.

Ions may less preferably be transferred into the first ion trap T1 or between ion traps using DC focusing lenses or an ion guide employing a central guide wire with a radially DC or RF containing field with or without collision gas.

According to another embodiment ions may be introduced axially or radially from one or more continuous or pulsed ion sources 1 into the first T1 and/or second T2 ion traps. According to a yet further embodiment ions from a continuous ion source may be gated and temporarily stored in a transfer region prior to being transferred to the first ion trap T1.

The RF voltage supply for each ion trap T1,T2 may be derived from a single RF generator using different resistors to generate different amplitudes for each ion trap T1,T2.

Figure 2:
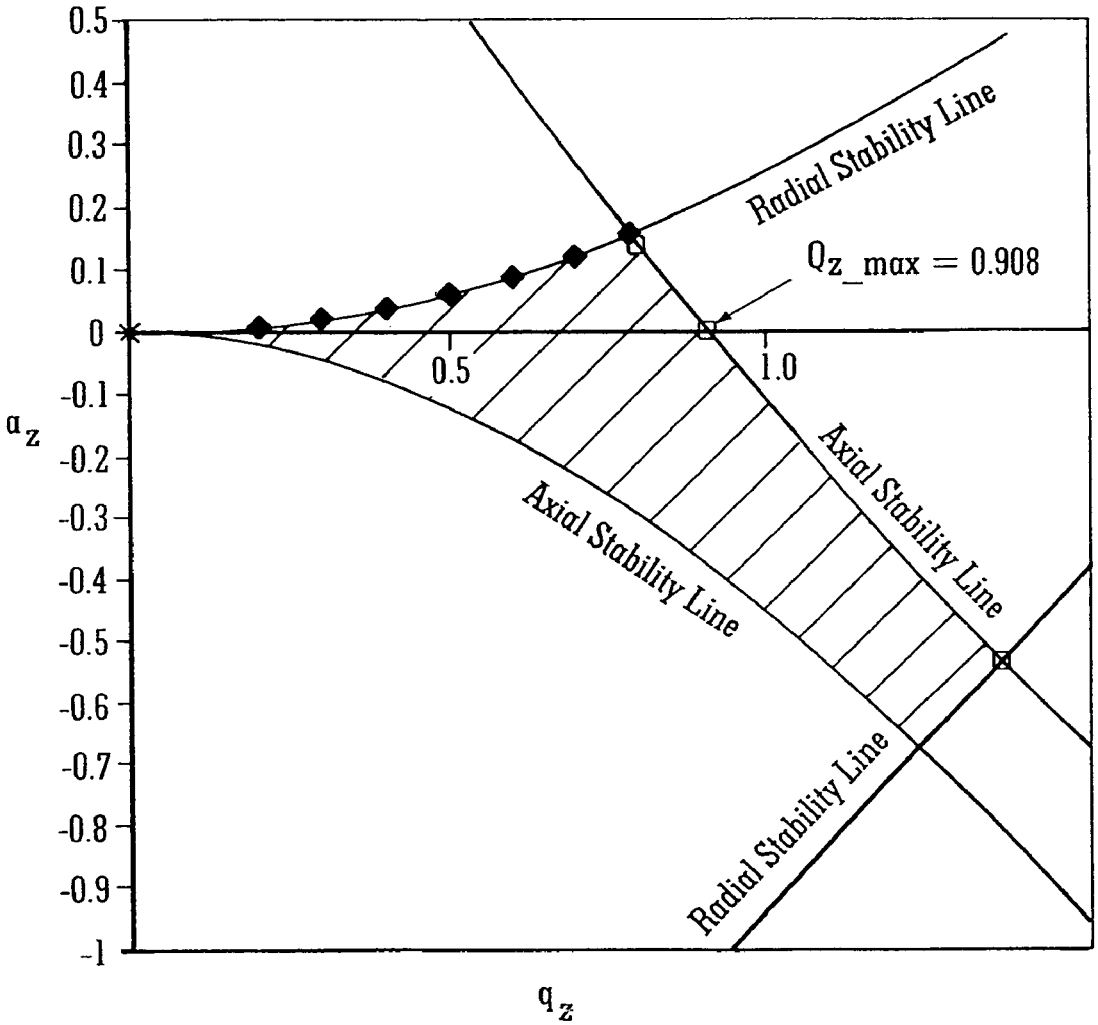
FIG. 2 shows a Mathieu Stability Diagram for a quadrupole ion trap.

Ions having certain mass to charge ratios are stable in a 3D quadrupole ion trap under operating conditions which may be summarised in the form of a Mathieu stability diagram as shown in FIG. 2 and expressed in terms of the Mathieu coordinates $a_z$ and $q_z$. The shaded region of FIG. 2 represents ions that are both radially and axially stable. The Mathieu coordinates $a_z$ and $q_z$:

$$q_z = \frac{4V_{rf}}{\frac{m}{z}(r_0\omega)^2}$$

$$a_z = \frac{-8U_{dc}}{\frac{m}{z}(r_0\omega)^2}$$

where $V_{rf}$ is the amplitude (0 to peak) of the RF voltage applied to the central ring electrode (or between the ring electrode and the end-cap electrodes), $r_0$ is the inscribed radius of the central ring electrode, ω is the angular frequency of the applied RF voltage, $U_{dc}$ is the DC voltage applied between the ring electrode and the end-cap electrodes and m/z is the mass to charge of an ion within the 3D quadrupole ion trap.

It is known that 3D (Paul) quadrupole ion traps do not store ions below a certain mass to charge ratio known as the Low Mass Cut Off ("LMCO"). If the central ring electrode is maintained at the same DC voltage as the end-cap electrodes (i.e. if $U_{dc}$ is set at zero volts and hence $a_z$=0) then there is a maximum $q_z$ value at which point ions become axially unstable. This maximum $q_z$ value is $q_{z_{13}\,max}$=0.908. At this setting of $q_z$ the LMCO may be calculated as follows:

$$LMCO = \frac{4V_{rf}}{q_{z_max}(r_0\omega)^2}$$

As will be appreciated from considering the above equation, the LMCO may be lowered either by reducing $V_{rf}$ or by increasing $r_0$ or ω. Conversely, increasing $V_{rf}$ has the effect of increasing the LMCO.

According to the preferred embodiment in order to overcome the mass range limitation inherent with a quadrupole ion trap, two (or more) ion traps T1,T2, for example 3D quadrupole ion traps, are provided in series with a first ion trap T1 preferably arranged to receive ions from an ion source 1. Some ions of interest having mass to charge ratios below the LMCO of the first ion trap T1 will become axially unstable within the first ion trap T1. These ions will be axially ejected from the first ion trap T1 but the ions of interest are preferably not lost since they will become trapped in the second ion trap T2 which is preferably downstream of the first ion trap T1. The second ion trap T2 is preferably configured to have a lower LMCO than the first ion trap T1. Ions having mass to charge ratios lower than the LMCO of the second ion trap T2 are either not ions of interest or alternatively further additional ion traps (not shown) with progressively decreasing LMCOs may additionally be provided in series with the first and second ion traps T1,T2 to trap these ions and to further increase the mass range of the overall ion trapping system.

Ions that have mass to charge ratios below the LMCO of the first ion trap T1 are preferably transferred in one axial direction by the application of a small DC (or AC) field applied across the end-caps of the first ion trap T1. Ions which have a mass to charge ratio below the LMCO of the first ion trap T1 are preferably trapped in the second ion trap T2 downstream of the first ion trap T1 and which has a LMCO lower than the LMCO of the first ion trap T1. The ions trapped and analysed may be either positively or negatively charged.

In the embodiment shown in FIG. 1 an ion detector 2 is provided downstream of the first and second ion traps T1,T2. According to further (unillustrated) embodiments three, four, five, six, seven, eight, nine, ten or more than ten ion traps may be provided in series in order to provide an ion trapping system having a yet further improved overall mass range. As will be appreciated, in such embodiments the ion traps may have progressively lower LMCO's.

A particularly preferred feature of the preferred embodiment is that the amplitude of the AC or RF voltage $V_{rf}$ applied to e.g. the ring electrode (or less preferably between the ring electrode and the end-cap electrodes) of the first ion trap T1 may be substantially higher than the voltage which might otherwise be conventionally applied to a quadrupole ion trap in a comparable situation. Although increasing the amplitude of the AC or RF voltage applied to the electrode of the first ion trap T1 has the effect of increasing the LMCO of the first ion trap T1, ions of interest having mass to charge ratios below the LMCO of the first ion trap T1 will not be lost as they will be trapped in the second ion trap T2 downstream of the first ion trap T1.

As will be seen from the following equation for the axial pseudo-potential well depth $D_z$, increasing the amplitude $V_{rf}$ of the AC or RF voltage applied to the ring electrode of first ion trap T1 has the beneficial effect of increasing the axial pseudo-potential well depth within the first ion trap T1. Accordingly, ions having either higher mass to charge ratio values and/or ions having greater kinetic energies will preferably be trapped more effectively within the first ion trap T1. Ions having greater kinetic energies will be trapped more effectively within the first ion trap T1 since ions must (to a first approximation) have a greater kinetic energy than the pseudo-potential axial well depth in order to escape from being trapped within the ion trap. The pseudo-potential axial well depth is given by;

$$D_z = \frac{V_{rf}^2}{2\frac{m}{z}(r_0\omega)^2}$$

It is clear from the above equation that increasing the amplitude of the applied AC or RF voltage $V_{rf}$ has the effect of increasing the axial pseudo-potential well depth. Similarly, the axial well depth may be increased by reducing the frequency of applied AC or RF voltage or by reducing the radius $r_o$ of the central ring electrode.

Figure 3:
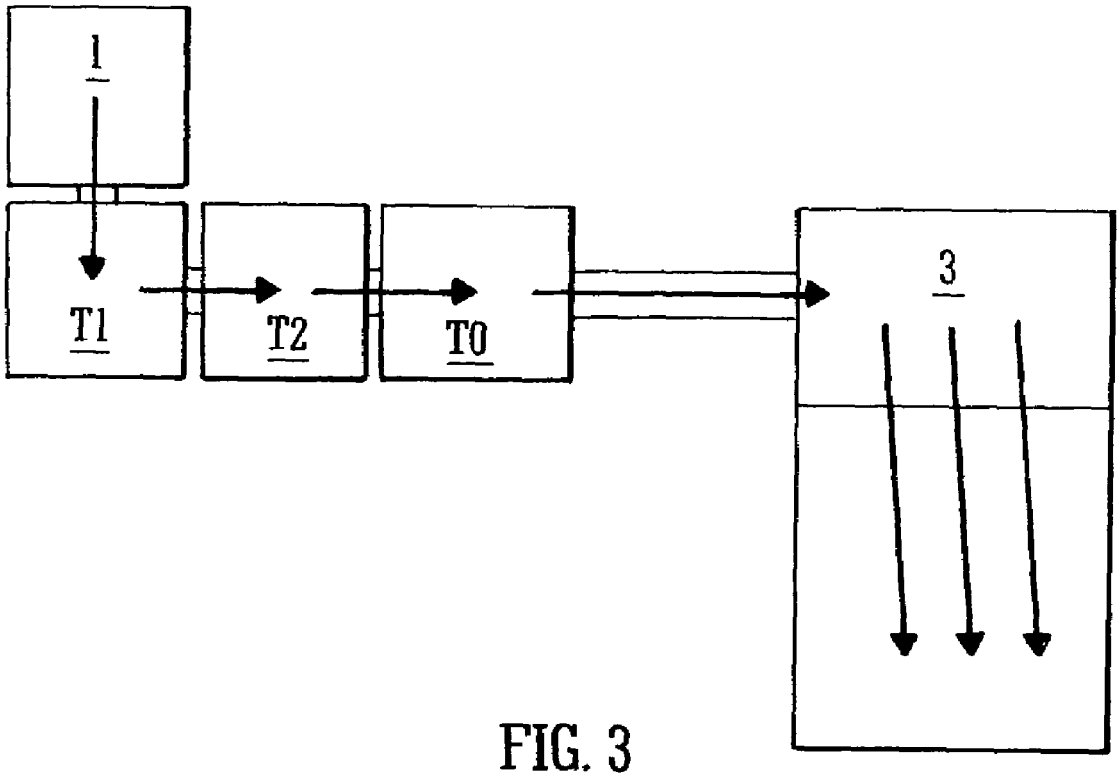
FIG. 3 shows an ion trapping system according to the preferred embodiment which includes a further ion trap for assisting in coupling the ion trapping system to an orthogonal acceleration Time of Flight mass analyser.

FIG. 3 shows a particularly preferred embodiment for performing MS experiments wherein an ion trapping system comprising two ion traps T1,T2 is coupled to an orthogonal acceleration Time of Flight mass analyser via a further ion trap T0. The further ion trap TO may comprise a 3D quadrupole ion trap but according to other embodiments may comprise other forms of ion traps.

In order to efficiently transfer all the parent ions stored in the first and second ion traps T1,T2 into an orthogonal acceleration Time of Flight mass analyser it is desirable to limit the mass range of ions transferred to the Time of Flight mass analyser at any one point in time so that the ions received by the Time of Flight mass analyser in any one pulse of ions have a limited range of mass to charge ratios. As will be explained in more detail below, it is desirable to limit the range of mass to charge ratios of ions received into the extraction region 3 of a Time of Flight mass analyser so that all the ions received by the mass analyser are still present in the extraction region 3 at the point in time when an electrostatic pulse is applied to electrodes in the extraction region 3 in order to pulse ions out of the extraction region 3 and into the drift or flight region of the Time of Flight mass analyser. If the ions pulsed into a Time of Flight mass analyser have a large range of mass to charge ratios then since the ions will in effect have passed through a short drift or flight region in order to reach the extraction region 3 then the ions will have become slightly temporally dispersed according to their mass to charge ratio. Accordingly, some ions will have passed beyond the end of the extraction region 3 whilst other ions will not have yet reached the extraction region 3 when ions are pulsed out of the extraction region and into the drift or flight region of the Time of Flight mass analyser, Accordingly, if ions having a relatively large range of mass to charge ratios are pulsed into a Time of Flight mass analyser then the duty cycle will be reduced since a proportion of those ions will not be orthogonally accelerated into the drift or flight region of the Time of Flight mass analyser. The further ion trap T0 is provided to address this problem and will be described in more detail below.

Ions are also preferably ejected and transferred out of the first and second ion traps T1,T2 by mass-selective instability. The process involves ramping up the AC or RF voltage amplitude applied to the ring electrodes and pushing ions having low mass to charge ratios above a $q_z$ value of 0.908. An alternative method for mass selection is resonant excitation wherein either a specific or a broadband of secular frequencies are applied to axially eject or retain groups of ions having particular mass to charge ratios. A supplementary RF dipole electric field may be applied across the end-cap electrodes and may be used in conjunction with a mass-selective instability scan.

Ions which have been mass-selectively ejected from the first and second ion traps T1,T2 are relatively energetic and these ions are then preferably trapped and collisionally cooled (i.e. thermalised) within the further ion trap T0. Once the ions have been collisionally cooled the RF voltage applied to the further ion trap T0 is then preferably switched OFF or otherwise reduced substantially. The collisional cooling gas pressure may also be reduced substantially at the same time. For example, the pressure within the further ion trap T0 may be allowed to reduce from e.g. $10^{-3}$ mbar to $<10^{-4}$ mbar. If the further ion trap T0 is a quadrupole ion trap then an axial DC field may then be applied across one or more of the end-cap electrodes and/or ring electrodes of the further ion trap T0 so that ions are pulsed out of the further ion trap T0. The axial DC field is applied to accelerate and transfer ions from the further ion trap T0 into the extraction region 3, for example, of the orthogonal acceleration Time of Flight mass analyser.

The spread of ion energies in the axial direction of the ions entering the extraction region 3 of the Time of Flight mass analyser will depend upon their thermal energy after collisional cooling with, for example, helium gas at room temperature in the further ion trap T0. Ions which have been thermalised will have an energy of approximately 0.05 ev.

After application of an electrostatic extraction pulse of approximately 100V across the end-cap electrodes of the further ion trap T0 ions will assume differential kinetic energies depending upon their location within the further ion trap T0 when the extraction pulse was applied. Ions pulsed out of the further ion trap T0 may therefore have a mean kinetic energy of e.g. 50 eV and an energy spread of ±5 eV. Without collisionally cooling the ions in the further ion trap T0 the ion energy spread of the ions ejected from the first and second ion traps would be significantly higher and may have an adverse effect upon a Time of Flight mass analyser attempting to mass analyse the ions. Reducing the energy spread to a few eV ensures that the Time of Flight mass analyser is not adversely affected.

After the ions reach the extraction region 3 of the orthogonal acceleration Time of Flight mass analyser, an orthogonal electrostatic pulse is then preferably applied to the extraction region 3 so as to accelerate ions into the drift or flight region of the Time of Flight mass analyser. The Time of Flight mass analyser may comprise a reflectron. The above method of collisionally cooling ions with the further ion trap T0 and transferring ions from the further ion trap T0 to the extraction region 3 in a pulsed non mass-selective manner has the important advantage of minimising the energy spread of ions exiting from the further ion trap T0. This has the effect of optimising the sensitivity and resolution of the orthogonal acceleration Time of Flight mass analyser. Scanning a quadrupole ion trap such as the first and/or second ion traps T1,T2 in order to mass-selectively eject ions causes those ions to be driven or excited into a state of instability. Therefore, by avoiding mass-selectively scanning the ions out of the further ion trap T0 the ions once collisionally cooled in the further ion trap T0 remain in a relatively unenergetic state which is advantageous when the ions are transmitted to a Time of Flight mass analyser. Another important advantage of the embodiment shown in FIG. 3 is that ions can be mass-selectively ejected from the first and/or second ion traps T1,T2 into the further ion trap T0 in such a way that the ions in the further ion trap T0 which are then onwardly transmitted to the Time of Flight mass analyser have a limited range of mass to charge ratios which is desirable in order to optimise the duty cycle of the Time of Flight mass analyser.

In spite of the above, according to a less preferred embodiment the AC or RF voltage applied to the further ion trap T0 may nonetheless still be maintained and ions could, less preferably, be axially ejected from the further ion trap T0 into the orthogonal acceleration Time of Flight mass analyser either by resonant ejection (wherein an oscillating AC voltage is applied between the end-cap electrodes) or by mass selective ejection (wherein the RF voltage is raised, or the RF frequency is lowered, or a DC voltage is applied between any or all of the ring electrodes and the end-cap electrodes). Mass-selectively ejecting ions from the further ion trap T0 is less preferred since the ion energy spread of the ions is increased which is generally undesirable when using Time of Flight mass analyser. However, although the increased energy spread may be disadvantageous, the further ion trap T0 may emit ions having a limited range of mass to charge ratios which will improve the duty cycle of the Time of Flight mass analyser. Such an arrangement may offer some advantages over conventional arrangements but is less preferred compared to using DC extraction techniques for the reasons given above.

At the point in time when the extraction pulse of the orthogonal acceleration Time of Flight mass analyser is energised it is desirable that the lowest mass to charge ratio ions received from the further ion trap T0 will not quite have reached the end of the extraction region 3 whilst the highest mass to charge ratio ions will have just entered the extraction region 3. Engineering constraints and other considerations effectively limit the physical position or length of the extraction region 3 and this effectively limits the mass range of ions which can be orthogonally accelerated with a near 100% duty cycle in any one pulse. In order to address this problem the AC or RF and/or DC voltages of the penultimate ion trap (i.e. the second ion trap T2 in the case of the embodiment shown in FIG. 3) may preferably be controlled so as to axially transfer only ions having mass to charge ratios within a sub-range or fraction of the overall range of mass to charge ratios of ions stored within the (second) ion trap T2 into the last ion trap (i.e. further ion trap T0). Ions are therefore preferably mass-selectively ejected from the (second) ion trap T2 into the further ion trap T0 so that all the ions which are then subsequently pulsed out of the further ion trap T0 are substantially subsequently orthogonally accelerated within the extraction region 3 of the Time of Flight mass analyser.

After a group of ions has been mass analysed by the orthogonal acceleration Time of Flight mass analyser, another sub-range or fraction of the ions stored in the second ion trap T2 may then be transferred into the further ion trap T0 to be collisionally cooled prior to being passed to the Time of Flight mass analyser. A sub-range or fraction of ions stored in the first ion trap T1 may also be transferred to the second ion trap T2 for onward transmission to the further ion trap T0 or for the process of mass-selectively ejecting some ions from the second ion trap T2 to be repeated. This process may be repeated a number of times until all the ions in the first and second ion traps T1,T2 have been transferred to the Time of Flight mass analyser via the further ion trap T0 in a number of stages. The further ion trap T0 may be considered to constitute a collisional cooling stage which reduces the energy spread of ions enabling the Time of Flight mass analyser to operate more effectively.

The embodiment shown in FIG. 3 can therefore be considered to use at least two ion traps T1,T2 to increase the overall mass range of ions stored in ion trapping system T1,T2 by arranging for the LMCO of the second ion trap T2 to be lower than the LMCO of the first ion trap T1. The embodiment shown in FIG. 3 also advantageously optimises the mass to charge ratio range of ions transmitted to the orthogonal acceleration Time of Flight mass analyser by using a further ion trap T0. The further ion trap T0 also collisionally cools ions within the further ion trap T0 thereby reducing the ion energy spread.

An example of a MS mode of operation will now be described in more detail with reference to FIG. 3. The ion source 1 may according to one embodiment comprise a MALDI ion source which may, for example, typically produce ions having mass to charge ratios in the range 30–3000. Ions of particular interest may have mass to charge ratios in the range 100–3000 i.e. ions having mass to charge ratios in the range 30–100 may not be of particular interest and may be lost. The ions from the ion source 1 are preferably transferred into the first ion trap T1 and the ions are preferably collisionally cooled within the first ion trap T1.

The LMCO of the first ion trap T1 may be set, for example, at m/z 300 so that ions having relatively high mass to charge ratios e.g. up to m/z 3000 are more efficiently trapped within the first ion trap T1 than they would otherwise be since a higher AC or RF amplitude $V_{rf}$ can be applied to the ring electrode(s) (or less preferably between the ring electrode(s) and the end-cap electrodes) of the first ion trap T1. Preferably, the end-cap electrode(s) of the first ion trap T1 are grounded. The relatively higher AC or RF voltage amplitude applied to the ring electrodes of the first ion trap T1 results in a greater axial pseudo-potential well depth being provided within the first ion trap T1 which improves the trapping of high mass to charge ratio ions and energetic ions.

A slight DC bias may be applied across the end-cap electrodes of the first ion trap T1 so that ions having mass to charge ratios below the LMCO of the first ion trap T1 (i.e. m/z<300) and which are axially unstable within the first ion trap T1 will be axially ejected from the first ion trap T1 in the direction of the second ion trap T2. The low mass to charge ratio ions ejected from the first ion trap T1 are transferred whilst preferably undergoing further collision cooling and become trapped in the second ion trap T2 which is preferably downstream of the first ion trap T1.

The LMCO for the second ion trap T2 is preferably set lower than the LMCO of the first ion trap T1. For example, the LMCO of the second ion trap T2 may be set at m/z 100 (compared with m/z 300 for the first ion trap T1). Ions trapped in the first ion trap T1 will therefore have mass to charge ratios within the range m/z 300–3000 and ions trapped within the second ion trap T2 will have mass to charge ratios within the range m/z 100–300.

If the distance from the origin of the further ion trap T0 to the start of the orthogonal extraction region 3 of the Time of Flight mass analyser is 100 mm and the distance from the origin of the further ion trap T0 to the end of the orthogonal extraction region 3 is 141.4 mm then for efficient ion transfer the maximum mass to charge ratio divided by the minimum mass to charge ratio of ions in any packet of ions received by the Time of Flight mass analyser should be less than:

$$\left(\frac{141.4}{100}\right)^2 = 2.00$$

According to one embodiment therefore, ions are preferably transferred from the second ion trap T2 to the further ion trap T0 in two (or more) separate stages. Ions having mass to charge ratios in the range m/z 100–200 may be transferred, for example, from the second ion trap T2 in a first stage and ions having mass to charge ratios in the range m/z 200–300 may be transferred out of the second ion trap T2 in a second stage. After these two stages the second ion trap T2 will now be effectively empty of ions. Ions from the first ion trap T1 may then be transferred via the second ion trap T2 and via the further ion trap T0 to the extraction region 3 of the Time of Flight mass analyser. For example, ions having mass to charge ratios in the range m/z 300–600 may be transferred out of the first ion trap T1 in one stage followed in the next stage by ions having mass to charge ratios in the range m/z 600–1200, followed by ions having mass to charge ratios in the range m/z 1200–2400 followed finally, in a last stage, by ions having mass to charge ratios in the range m/z 2400–3000. As will be appreciated, in each stage of transferring ions the ratio of the maximum mass to charge ratio to the minimum mass to charge ratio preferably does not exceed 2. According to this particular example ions are transferred to the Time of Flight mass analyser in six discrete stages and a total of six orthogonal extraction pulses are required in order to mass analyse ions effectively across the entire desired m/z range of 100–3000. As will be appreciated since the first and second ion traps T1,T2 are preferably operated in mass-selective (i.e. scanning) modes of operation the order in which ions are transferred may be varied so long as preferably the ions received in the extraction region 3 of the Time of Flight mass analyser in any one pulse have a limited range of mass to charge ratios. According to an embodiment the ratio of the maximum mass to charge ratio to the minimum mass to charge ratio is less than or equal to 4, further preferably less than or equal to 3, further preferably less than or equal to 2.

In order to pulse ions out of the further ion trap T0 cooling gas is preferably removed or allowed to disperse from the further ion trap T0 so that the pressure within the further ion trap T0 drops to e.g. $<10^{-4}$ mbar. The AC or RF voltage applied to the further ion trap T0 is also preferably switched OFF, and one or more DC extraction pulses are preferably applied across the end-cap electrodes of the further ion trap T0 in order to accelerate ions out of the further ion trap T0 and into the extraction region 3 of the orthogonal acceleration Time of Flight mass analyser.

FIG. 4 illustrates in more detail how the arrangement of ion traps shown in FIG. 3 may be operated in order to perform a typical MS experiment. The first ion trap T1, the second ion trap T2 and the further ion trap T0 are preferably similar 3D (Paul) quadrupole ion traps. The frequency of the RF voltage applied to all three ion traps T1,T2,T0 is preferably 0.8 MHz (5.0 Rad/μs) and the radius of the central ring electrode $r_o$ of each ion trap T1,T2,T0 is preferably 0.707 cm. $U_{dc}$ is preferably 0V for all the ion traps T1,T2,T0 and the ion traps T1,T2,T0 are preferably supplied with helium gas at a pressure of, for example, 0.001 mbar. As will be appreciated from the description below, where the RF low and high voltages are shown in FIG. 4 as being the same in a stage of operation then the ion trap is not scanned during that particular stage.

In a first stage S1 ions having mass to charge ratios in the range 300–3000 are stored in the first ion trap T1 wherein an RF voltage of 913.8 V is applied to the ring electrode(s) of the first ion trap T1. Ions having mass to charge ratios in the range 100–300 are stored in the second ion trap T2 wherein an RF voltage of 304.6 V is applied to the ring electrode(s) of the second ion trap T2. The further ion trap T0 is preferably initially empty of ions.

In the next stage S2 the amplitude of the RF voltage applied to the ring electrode(s) of the second ion trap T2 is scanned from 304.6 V to 609.2 V with the effect that ions having mass to charge ratios in the range 100–200 are ejected from the second ion trap T2 and are transferred to the further ion trap T0 where they are collisionally cooled.

In the next stage S3, the cooling gas within the further ion trap T0 is allowed to disperse and the pressure within the further ion trap T0 is allowed to effectively drop by switching OFF a valve pump supplying cooling gas to the further ion trap T0. The 304.6 V RF voltage supplied to the ring electrode(s) of the further ion trap T0 is turned OFF and ions are pulsed out of the further ion trap T0 into the orthogonal acceleration region 3 of the Time of Flight mass analyser. Cooling gas is then re-introduced into the further ion trap T0 and a RF voltage of 609.2V is applied to the ring electrode(s) of the further ion trap T0 so that the further ion trap T0 is optimised to receive at the next stage ions having mass to charge ratios above 200 mass to charge ratio units.

In a fourth stage S4, the RF voltage applied to the second ion trap is scanned from 609.2 V to 913.8 V which has the effect of ejecting the remaining ions having mass to charge ratios within the range 200–300 from the second ion trap T2 into the further ion trap T0 where they are collisionally cooled.

In a fifth stage S5, the cooling gas within the further ion trap T0 is allowed to disperse and the pressure within the further ion trap T0 is allowed to effectively drop by switching OFF a valve pump supplying cooling gas to the further ion trap T0. The 609.2 V RF voltage supplied to the ring electrode(s) of the further ion trap T0 is turned OFF and ions are pulsed out of the further ion trap T0 into the orthogonal acceleration region 3 of the Time of Flight mass analyser. Cooling gas is then re-introduced into the further ion trap T0 and a RF voltage of 913.8V is applied to the ring electrode(s) of the further ion trap T0 so that the further ion trap T0 is optimised to receive in a subsequent stage ions having mass to charge ratios above 300 mass to charge ratio units.

In a sixth stage S6, the RF voltage supplied to the first ion trap T1 is scanned from 913.8 V to 1827.6 V which has the effect of ejecting ions having mass to charge ratios within the range 300–600 mass to charge ratio units from the first ion trap T1 into the second ion trap T2.

In the next seventh stage S7 the amplitude of the RF voltage applied to the ring electrode(s) of the second ion trap T2 is scanned from 913.8 V to 1827.6 V with the effect that ions having mass to charge ratios in the range 300–600 are ejected from the second ion trap T2 into the further ion trap T0 where they are collisionally cooled.

In an eighth stage S8, the cooling gas within the further ion trap T0 is allowed to disperse and the pressure within the further ion trap T0 is allowed to effectively drop by switching OFF a valve pump supplying cooling gas to the further ion trap T0. The 913.8 V RF voltage supplied to the ring electrode(s) of the further ion trap T0 is turned OFF and ions are pulsed out of the further ion trap T0 into the orthogonal acceleration region 3 of the Time of Flight mass analyser. Cooling gas is then re-introduced into the further ion trap To and a RF voltage of 1827.6V is applied to the ring electrode(s) of the further ion trap T0 so that the further ion trap T0 is optimised to receive at a subsequent stage ions having mass to charge ratios above 600 mass to charge ratio units.

In a ninth stage S9, the RF voltage supplied to the first ion trap T1 is scanned from 1827.6 V to 3655.2 V which has the effect of ejecting ions having mass to charge ratios within the range 600–1200 mass to charge ratio units from the first ion trap T1 into the second ion trap T2.

In the next tenth stage S10 the amplitude of the RF voltage applied to the ring electrode(s) of the second ion trap T2 is scanned from 1827.6 V to 3655.2 V with the effect that ions having mass to charge ratios in the range 600–1200 are ejected from the second ion trap T2 into the further ion trap T0 where they are collisionally cooled.

In an eleventh stage S1, the cooling gas within the further ion trap T0 is allowed to disperse and the pressure within the further ion trap T0 is allowed to effectively drop by switching OFF a valve pump supplying cooling gas to the further ion trap T0. The 1827.6 V RF voltage supplied to the ring electrode(s) of the further ion trap T0 is turned OFF and ions are pulsed out of the further ion trap T0 into the orthogonal acceleration region 3 of the Time of Flight mass analyser. Cooling gas is then re-introduced into the further ion trap T0 and a RF voltage of 3655.2V is applied to the ring electrode(s) of the further ion trap T0 so that the further ion trap is optimised to receive at a subsequent stage ions having mass to charge ratios above 1200 mass to charge ratio units.

In a twelfth stage S12, the RF voltage supplied to the first ion trap T1 is scanned from 3655.2 V to 7310.5 V which has the effect of ejecting ions having mass to charge ratios within the range 1200–2400 mass to charge ratio units from the first ion trap T1 into the second ion trap T2.

In the next thirteenth stage S13 the amplitude of the RF voltage applied to the ring electrode(s) of the second ion trap T2 is scanned from 3655.2 V to 7310.5 V with the effect that ions having mass to charge ratios in the range 1200–2400 are ejected from the second ion trap T2 into the further ion trap T0 where they are collisionally cooled.

In an fourteenth stage S14, the cooling gas within the further ion trap T0 is allowed to disperse and the pressure within the further ion trap T0 is allowed to effectively drop by switching OFF a valve pump supplying cooling gas to the further ion trap T0. The 3655.2 V RF voltage supplied to the ring electrode(s) of the further ion trap T0 is turned OFF and ions are pulsed out of the further ion trap T0 into the orthogonal acceleration region 3 of the Time of Flight mass analyser. Cooling gas is then re-introduced into the further ion trap T0 and a RF voltage of 7310.5V is applied to the ring electrode(s) of the further ion trap T0 so that the further ion trap T0 is optimised to receive in a subsequent stage ions having mass to charge ratios above 2400 mass to charge ratio units.

In a fifteenth stage S15, the RF voltage supplied to the first ion trap T1 is scanned from 7310.5 V to 9138.1 V which has the effect of ejecting ions having mass to charge ratios within the range 2400–3000 mass to charge ratio units from the first ion trap T1 into the second ion trap T2, thereby emptying the first ion trap T1 of ions.

In the next sixteenth stage S16 the amplitude of the RF voltage applied to the ring electrode(s) of the second ion trap T2 is scanned from 7310.5 V to 9138.1 V with the effect that ions having mass to charge ratios in the range 2400–3000 are ejected from the second ion trap T2 into the further ion trap T0 thereby emptying the second ion trap T2. The ions are preferably collisionally cooled within the further ion trap T0.

In a final seventeenth stage S17, the cooling gas within the further ion trap T0 is allowed to disperse and the pressure within the further ion trap T0 is allowed to effectively drop by switching OFF a valve pump supplying cooling gas to the further ion trap T0. The 7310.5 V RF voltage supplied to the ring electrode(s) of the further ion trap T0 is turned OFF and ions are pulsed out of the further ion trap T0 into the orthogonal acceleration region 3 of the Time of Flight mass analyser Cooling gas may then be re-introduced into the further ion trap T0 and a RF voltage applied to the ring electrode(s) of the further ion trap T0 ready for the next cycle.

In order to pulse ions out of the further ion trap T0 and into the extraction region 3 of a Time of Flight mass analyser a DC voltage preferably in the range 10–500 V may be applied across the end-cap electrodes of the further ion trap T0 in order to accelerate ions out of the further ion trap T0. The DC voltage may be applied, for example, for a minimum of 1 μs and according to other embodiments the DC extraction voltage may be applied for at least 5, 10, 15, 20, 25, 30, 35, 40, 45, 50, 55, 60, 65, 70, 75, 80, 85, 90, 95 or 100 μs.

In the example described above in relation to FIG. 4, ions are scanned out of either the first ion trap T1 or the second ion trap T2 ten times per cycle. Each scan of the RF voltage applied to the ion trap preferably takes approximately 50 ms. The collisional cooling and pulsed extraction stage which occurs in the further ion trap T0 occurs six times per cycle in the example described in relation to FIG. 4. The ions are preferably collisionally cooled in the further ion trap T0 for approximately at least 30 ms. Once ions have been collisionally cooled in the further ion trap T0 then the RP voltage to the further ion trap T0 is preferably switched OFF, ions are pulsed out of the further ion trap T0, the RF voltage is re-applied and gas is re-introduced into the further ion trap T0. This process preferably takes of the order of 50 ms. The overall cycle time is preferably around 1.1 seconds. Not included in the calculation of the cycle time is the time taken to ionise the ions and transfer them into the first ion trap T1. The ion source is preferably pulsed and may be pulsed for example 10–100 times per second.

With reference back to FIG. 3 a MS/MS mode of operation may also be performed wherein the first ion trap T1 is controlled to selectively retain parent ions having a particular mass to charge ratio of interest whilst all other parent ions are preferably ejected out of the first ion trap T1.

The parent ions retained within the first ion trap T1 are then preferably collisionally fragmented within the first ion trap T1 by e.g. setting the $q_z$ value of the first ion trap T1 to about 0.3 which causes the parent ions to be sufficiently energetic that they fragment upon colliding with the background gas within the first ion trap T1. Preferably, resonant excitation is applied to specific parent ions and this causes repetitive higher energy collisions with e.g. helium gas within the first ion trap T1 so that the parent ions gain sufficient internal energy that Collisional Induced Dissociation (CID) occurs. Fragment ions having $q_z$>0.908 will be axially unstable within the first ion trap T1 and will exit the first ion trap T1 along the z-axis and will preferably become trapped within the second ion trap T2. Fragment ions may therefore be trapped in both the first and second ion traps T1,T2 and the fragment ions may be efficiently transferred via the second ion trap T2 and via the further ion trap T0 to the mass analyser in a similar manner to that described above in relation to the MS mode of operation.

Figure 5:
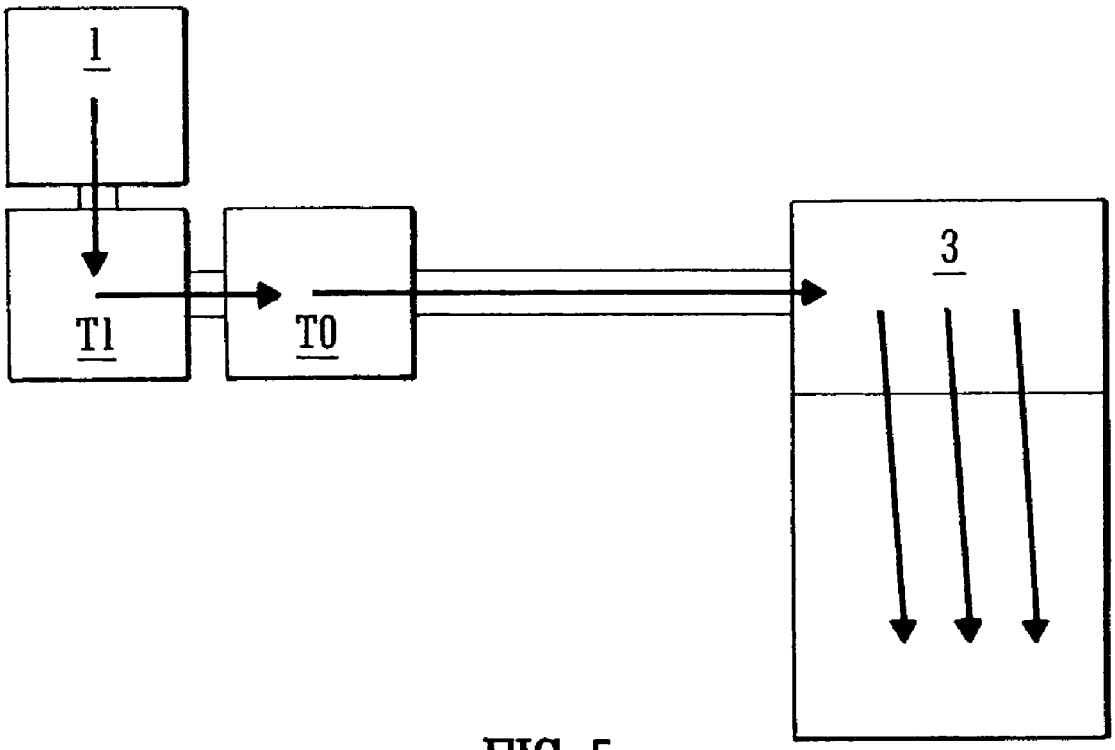
FIG. 5 shows a less preferred embodiment wherein a single mass-selective ion trap is coupled to an orthogonal acceleration Time of Flight mass analyser via a further ion trap.

According to a less preferred embodiment shown in FIG. 5 a single e.g. mass-selective ion trap T1 may be coupled to an orthogonal acceleration Time of Flight mass analyser via a further ion trap T0. Such an arrangement allows a limited mass range of ions to be collisionally cooled and then transferred to the Time of Flight mass analyser so that the ions received by the Time of Flight mass analyser in any one pulse are all substantially orthogonally accelerated into the drift region. The embodiment shown in FIG. 5 does not however afford the benefit of an improved mass range trapping system which requires two or more ion traps T1,T2 having different LMCOs.

Figure 6:
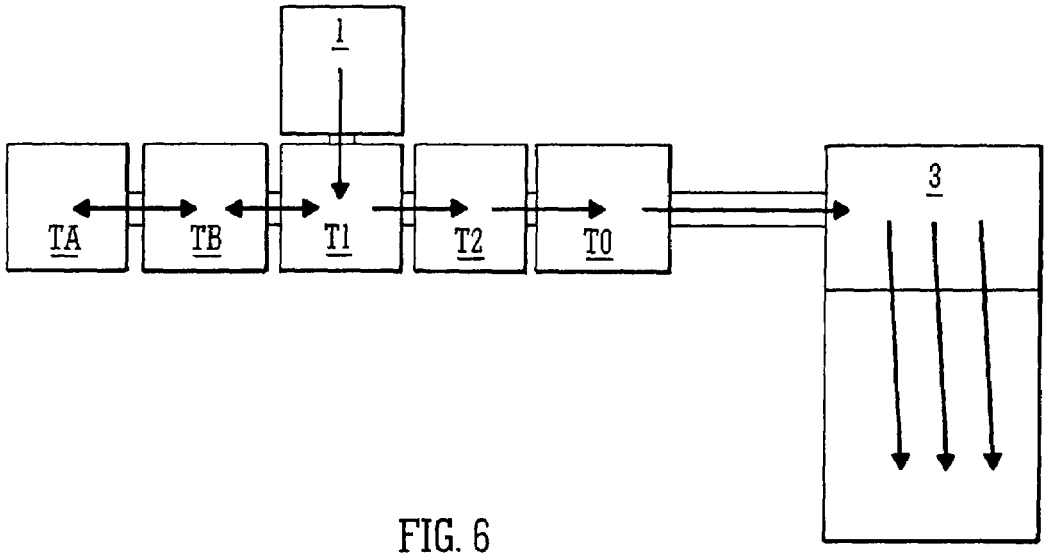
FIG. 6 shows an ion trapping system according to the preferred embodiment for performing MS/MS experiments wherein additional ion storage traps for storing parent ions are provided.

Although the embodiments shown in FIGS. 3 and 5 are capable of performing MS/MS experiments, parent ions other than those initially trapped in the first ion trap T1 may be effectively lost. In order to significantly increase the sampling efficiency of the parent ions, a further preferred embodiment shown in FIG. 6 is contemplated wherein additional ion traps TA,TB are provided to store parent ions ejected from the first ion trap T1 and which are not to be the subject of immediate MS/MS analysis. A second additional ion trap TB may preferably be configured to have a lower LMCO than a first additional ion trap TA so that an improved ion trapping system for storing parent ions which are not yet the subject of immediate mass analysis is provided.

Once a MS/MS experiment has been performed, the next parent ions of interest may be transferred from the first additional ion trap TA and/or the second additional ion trap TB into the first ion trap T1 wherein the parent ions are then subject to fragmentation.

According to an alternative embodiment all the ions trapped within the first and second additional ion traps TA and TB may be transferred back into the first ion trap T1 in, for example, a non mass-selective manner and then the next parent ions of interest may then selectively retained within the first ion trap T1 whilst all the other parent ions are mass-selectively ejected out of the first ion trap T1 and back into one or more of the additional ion traps TA,TB. Further additional ion traps (not shown) may also be provided to improve the trapping efficiency of parent ions awaiting further MS/MS analysis.

Ions may, for example, be generated by a MALDI ion source 1 and may typically have mass to charge ratios in the range m/z 30–3000. The ions emitted from the ion source 1 may be transferred to and collisional cooled within the first ion trap T1, although according to other embodiments ions may be generated within the first ion trap T1. A MS spectrum may have been previously acquired and it may be desired, for example, to obtain a MS/MS mass spectrum of parent ions having a particular mass to charge ratio e.g. 1500. Parent ions having mass to charge ratios other than 1500 may be ejected out of the first ion trap T1 and passed initially into the first additional ion trap TA. This may be achieved, for example, by applying a swept frequency to the end-cap electrodes of the first ion trap T1 which causes resonant excitation (axial modulation with a supplementary oscillating potential) of all ions except for the desired parent ions. The RF voltage applied to the first ion trap T1 may also be temporarily reduced to increase the LMCO.

According to another embodiment all the ions within the first ion trap T1 may be transferred into the first additional ion trap TA and then the parent ions of interest having mass to charge ratios of 1500 may then be transferred back from the first additional ion trap TA into the first ion trap T1 using similar methods as described above.

Parent ions having mass to charge ratios below the IMCO of the first additional ion trap TA may be trapped in a second (or yet further) additional ion trap TB which is preferably provided in series with the first additional ion trap TA and which preferably has, in use, a lower LMCO than the first additional ion trap TA.

Having isolated ions having a mass to charge ratio of 1500 in the first ion trap T1 and having preferably stored elsewhere (i.e. in additional ion traps TA,TB) all the other parent ions of interest, the $q_z$ for the first ion trap T1 may be set at 0.3 (for m/z 1500) to cause sufficient excitation for fragmentation of the parent ions to occur without either axial or radial ejection. The LMCO of the first ion trap T1 may be set to m/z 500. The LMCO for the second ion trap T2 downstream of the first ion trap T1 may be set at m/z 100 i.e. lower than the LMCO of the first ion trap T1. A background collisional gas is preferably retained within or is introduced into the first ion trap T1 and a resonant excitation function is preferably applied to the end-cap electrodes of the first ion trap T1 in order to increase the kinetic and internal energy of the parent ions so that they then fragment upon colliding within gas molecules within the first ion trap T1. Fragment ions having mass to charge ratios in the range m/z, for example 100–1500, may be produced by such collisional activation. Fragment ions having mass to charge ratios below m/z 500 will become axially unstable in the first ion trap T1 and are preferably axially ejected from the first ion trap T1 so that they become trapped in the second ion trap T2.

Fragment ions are now efficiently extracted from the first and second ion traps T1,T2 and passed to the mass analyser in a number of discrete stages in a similar manner to the MS mode of operation described above in relation to FIG. 4. In a first stage, ions in the range m/z 100–200 may be transferred from the second ion trap T2 to the further ion trap T0 where they are collisionally cooled before being transmitted to the Time of Flight mass analyser. In a second stage ions in the range m/z 200–400 nay be transferred from the second ion trap T2 to the further ion trap T0 where they are collisionally cooled before being transmitted to the Time of Flight mass analyser. In a third stage ions in the range m/z 400–500 may be transferred from the second ion trap T2 to the further ion trap T0 where they are collisionally cooled before being transmitted to the Time of Flight mass analyser.

The three stages described above result in the emptying of the second ion trap T2 of all fragment ions. Fragment ions having mass to charge ratios in the range m/z 500–1000 may then transferred from the first ion trap T1 to the Time of Flight mass analyser via the second ion trap T2 and via the further ion trap T0. Subsequently, fragment ions having mass to charge ratios in the range 1000–2000 mass to charge ratio units may be transferred from the first ion trap T1 via the second ion trap T2 and via the further ion trap T0 to the Time of Flight mass analyser.

Having acquired all the MS/MS data from one particular parent ion other MS/MS acquisitions may then be performed on some or preferably all of the remaining parent ions which have been meanwhile stored in the first and second additional ion traps TA and TB. Advantageously, none of the parent ions are lost and full MS/MS data may be acquired for all the parent ions of interest.

According to a less preferred and unillustrated embodiment, the first and second additional ion traps TA and TB may be interspersed between the first and second ion traps T1,T2 or may be placed downstream of the first and/or second ion traps T1,T2.

A particularly preferred ion trapping system and ion trap ion source will now be described with reference to FIG. 7. In order to reduce potential transmission losses between ion traps and in order to increase the homogeneity of the electric field when pulsing ions into the orthogonal acceleration Time of Flight mass analyser, the electrodes of the various ion traps may be constructed in the form of several cylindrical thin rings 10A,10B,10C. In the embodiment shown in FIG. 7 each ion trap comprises three such thin rings. Adjacent ion traps may furthermore be separated by common end-cap electrodes 11 incorporating high transmission grids 12 to reduce field penetration. Alternatively, some or all of the gridded end-cap electrodes 11 may be replaced with circular plate electrodes having relatively small apertures and which may, in one embodiment, form differential pumping apertures between vacuum stages.

Ions may be generated from a sample or target plate within or close to the first ion trap T1 by a laser 14 producing a laser beam 15. The firing of the laser 14 may be synchronised with the phase of the RF voltage applied to the ring electrodes 10A of the first ion trap T1 so that the ions generated on or at the sample or target plate 13 immediately fly into and within the first ion trap T1. The electric field applied to the first ion trap T1 therefore preferably effectively extracts ions at the moment they are generated so as to preferably avoid or minimise the risk that the ions are reflected back towards the sample or target plate 13 which might otherwise result in the ions being lost. The angle θ between the sample or target plate 13 and the ionising pulsed laser beam 15 (or less preferably electron beam) may be 90° in which case the pulsed laser beam 15 (or electron beam) may pass through the extraction region 3 of the orthogonal acceleration Time of Flight mass analyser. Angles <90° may also be used and are shown, for example, in the particular embodiment shown in FIG. 7. According to another embodiment a mirror or other reflective element may be provided between the ion trap ion source and the mass analyser. The mirror may, for example, be orientated at 45°. A laser beam may be directed at the mirror and then reflected on to the target or sample plate 13. Ions generated by the ion trap ion source may preferably be transmitted through a small aperture provided in the mirror or other reflective element.

According to the preferred embodiment the ring electrodes 10A,10B,10C of the first, second and further ion traps T1,T2,T0 are supplied with RF voltages having a frequency of 800 kHz. The amplitude of the RF voltages supplied to each of the first, second and further ion traps T1,T2,T0 may differ. The DC voltage applied to all the ion traps T1,T2,T0 is preferably set at zero. The first, second and further ion traps T1,T2,T0 are preferably provided with helium gas and maintained at a pressure of $10^{-3}$ mbar. Before ions are extracted from the further ion trap T0 into the orthogonal acceleration region 3 of the Time of Flight mass analyser, the pressure in the further ion trap T0 may be reduced to $<10^{-4}$ mbar. According to one embodiment, when the pressure in the further ion trap T0 is reduced the pressure in the first and/or second ion traps T1,T2 may also be reduced to a similar pressure as that of the further ion trap T0.

In order to maintain an ion trap at a pressure such that collisional cooling of ions occurs or collisional activation occurs for MS/MS experiments, helium gas may be introduced into the ion trap to raise the pressure in the ion trap to around $10^{-3}$ mbar. The helium or other gas may be introduced using a solenoid operated needle valve or a pulsed supersonic valve (available, for example, from R.M. Jordan Inc.). The pulsed supersonic valve may be operated so as to provide 50 μs pulses of gas at a 10 Hz repetition rate. Once collision or cooling gas has been introduced into an ion trap the gas may be considered to remain present within the ion trap for approximately 10 ms before it disperses or is pumped out of the ion trap by the vacuum pump. The precise time that the collision gas can be considered to remain effectively present within the ion trap depends upon the geometry of the ion trap and vacuum chamber, and the capacity of the vacuum pumps.

In all the embodiments described above, differential pumping systems may be employed between the first ion trap T1 and/or the second ion trap T2, and/or between the second ion trap T2 and the further ion trap T0, and/or between the further ion trap T0 and the mass analyser e.g. Time of Flight mass analyser. According to a one embodiment the further ion trap T0 downstream of the first and second ion traps T1,T2 may be provided in a separate vacuum chamber to that of the first and second ion traps T1,T2. Providing the further ion trap T0 in a separate vacuum stage allows the pressure of the gas in the further ion trap T0 to be more easily varied between $10^{-3}$ mbar (for collisional cooling) and $<10^{-4}$ mbar (for pulsed extraction of ions) whilst the first and second ion traps T1,T2 can, for example, be constantly maintained at around e.g. $10^{-3}$ mbar. According to a less preferred embodiment when the valve supplying gas to the further ion trap T0 is OFF, the valves supplying gas to the first and second ion traps T1,T2 may also be switched OFF.

Figure 7:
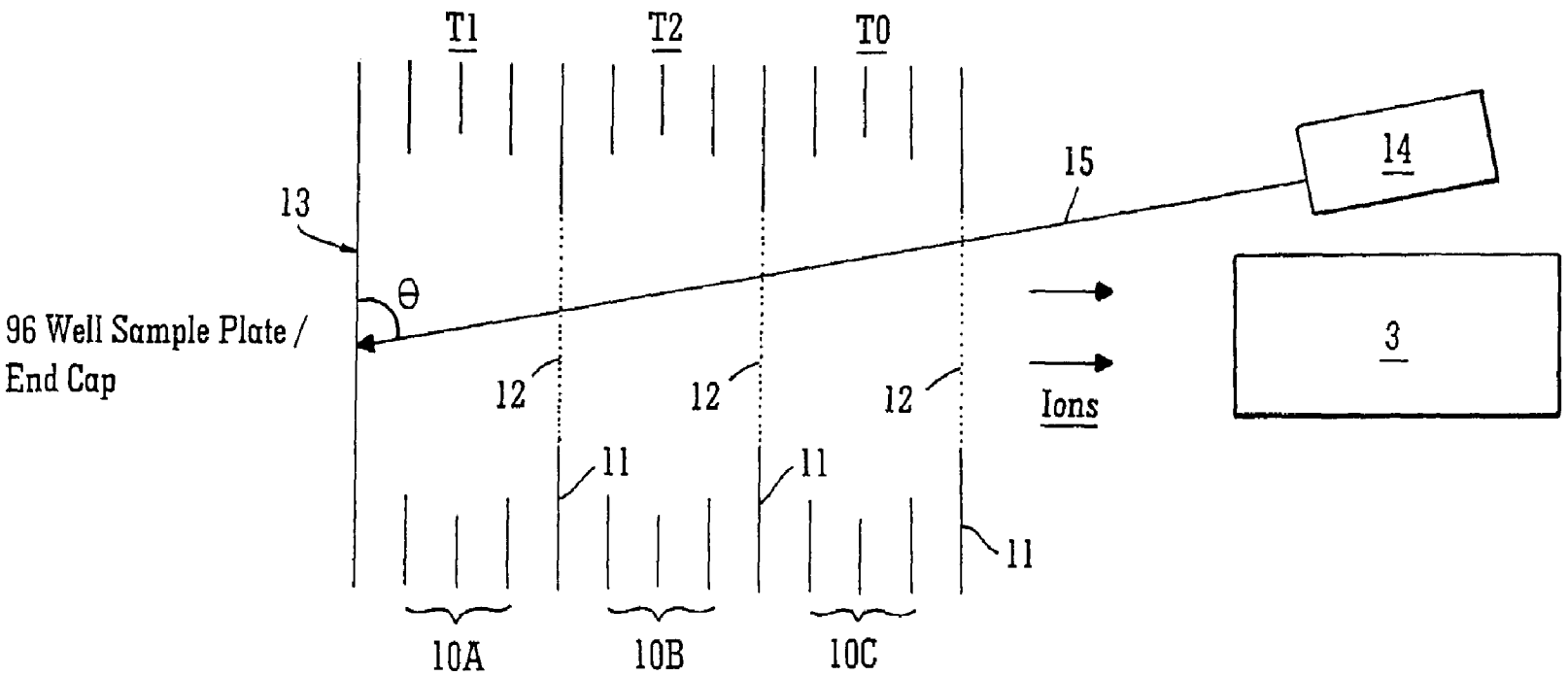
FIG. 7 shows an ion trap ion source according to an embodiment wherein a microtitre sample plate or other target plate forms part of one end-cap of an ion trap.

In the embodiment shown and described in relation to FIG. 7, the mesh end-cap electrode between the second ion trap T2 and the further ion trap T0 may be replaced by a differential pumping apertured electrode.

The embodiment shown and described with relation to FIG. 7 wherein ions are generated directly within an ion trap is particularly advantageous compared to conventional arrangements wherein ions are generated externally to an ion trap. If a pulse of ions is accelerated with a DC field from a point outside of an ion trap, then ions having different mass to charge ratios will have different flight times into the ion trap. The timing of the RF voltage applied to the ion trap therefore has to be carefully optimised or even switched OFF until all the desired ions are within the ion trap, otherwise they may be reflected backwards and lost. The acceptance and hence successful trapping of ions in a conventional ion trap is dependent upon the position, kinetic energy and mass to charge ratio of the ions being pulsed towards the ion trap at the time when the RF voltage is applied to the ion trap. Ions generated externally to the ion trap will therefore tend to have a significant variation in their position which will have an adverse effect upon the acceptance of ions into the ion trap.

In addition to the constraints imposed by the trapping potential, geometric constraints will also limit the acceptance of ions into a conventional ion trap. For examples some ions of low mass to charge ratio may have entered and passed through the exit end-cap electrode of the ion trap by the time that an effective RF trapping voltage is applied to the ion trap, whilst other ions having a relatively high mass to charge ratio may not have yet reached the ion trap by the time that an effective RF trapping voltage is applied to the ion trap. Conventional ion trapping arrangements may therefore exhibit mass to charge ratio discrimination effects. The ion trap ion source according to the preferred embodiment preferably does not suffer from such problems and therefore represents a significantly improved ion trapping and ion source system.

Although the present invention has been described with reference to preferred embodiments, it will be understood by those skilled in the art that various changes in form and detail may be made without departing from the scope of the invention as set forth in the accompanying claims.

The invention claimed is:

1. A mass spectrometer comprising:

a quadrupole ion trap;

a further ion trap arranged to receive ions ejected from said quadrupole ion trap; and a Time of Flight mass analyser arranged to receive and analyze only parent ions ejected from said further ion trap;

wherein in a first mode of operation said further ion trap receives a pulse of parent ions which have been mass-selectively ejected from or scanned out of said quadrupole ion trap, wherein the ratio of the maximum mass to charge ratio of parent ions in the pulse of ions to the minimum mass to charge ratio of ions in the pulse of ions is a maximum of x, and wherein $x \leqq 4.0$, and wherein the parent ions received from said quadrupole ion trap are collisionally cooled within said further ion trap.

2. A mass spectrometer as claimed in claim 1, wherein x is selected from the group consisting of: (i) 3.9; (ii) 3.8; (iii) 3.7; (iv) 3.6; (v) 3.5; (vi) 3.4; (vii) 3.3; (viii) 3.2; (ix) 3.1; (x) 3.0; (xi) 2.9; (xii) 2.8; (xiii) 2.7; (xiv) 2.6; (xv) 2.5; (xvi) 2.4; (xvii) 2.3; (xviii) 2.2; (xix) 2.1; (xx) 2.0; (xxi) 1.9; (xxii) 1.8; (xxiii) 1.7; (xxiv) 1.6; (xxv) 1.5; (xxvi) 1.4; (xxvii) 1.3; (xxviii) 1.2; and (xxix) 1.1.

3. A mass spectrometer as claimed in claim 1, wherein said quadrupole ion trap comprises a 3D (Paul) quadrupole ion trap comprising a ring electrode and two end-cap electrodes, said ring electrode and said end-cap electrodes having a hyperbolic surface.

4. A mass spectrometer as claimed in claim 1, wherein said quadrupole ion trap comprises one or more cylindrical ring electrodes and two substantially planar end-cap electrodes.

5. A mass spectrometer as claimed in claim 1, wherein said quadrupole ion trap comprises one, two, three or more than three ring electrodes and two substantially planar end-cap electrodes.

6. A mass spectrometer as claimed in claim 4, wherein one or more of said end-cap electrodes of said quadrupole ion trap comprise a mesh or grid.

7. A mass spectrometer as claimed in claim 1, wherein said quadrupole ion trap comprises a 2D (linear) quadrupole ion trap comprising a plurality of rod electrodes and two end electrodes.

8. A mass spectrometer as claimed in claim 1, wherein said further ion trap comprises a quadrupole ion trap.

9. A mass spectrometer as claimed in claim 8, wherein said further ion trap comprises a 3D (Paul) quadrupole ion trap comprising a ring electrode and two end-cap electrodes, said ring electrode and said end-cap electrodes having a hyperbolic surface.

10. A mass spectrometer as claimed in claim 8, wherein said further ion trap comprises one or more cylindrical ring electrodes and two substantially planar end-cap electrodes.

11. A mass spectrometer as claimed in claim 8, wherein said further ion trap comprises one, two, three or more than three ring electrodes and two substantially planar end-cap electrodes.

12. A mass spectrometer as claimed in claim 10, wherein one or more end-cap electrodes of said further ion trap comprise a mesh or grid.

13. A mass spectrometer as claimed in claim 8, wherein said further ion trap comprises a 2D (linear) quadrupole ion trap comprising a plurality of rod electrodes and two end electrodes.

14. A mass spectrometer as claimed in claim 1, wherein said further ion trap comprises a segmented ring set comprising a plurality of electrodes having apertures through which ions are transmitted.

15. A mass spectrometer as claimed in claim 1, wherein said Time of Flight mass analyser comprises an axial or orthogonal acceleration Time of Flight mass analyser.

16. A mass spectrometer as claimed in claim 1, wherein in said first mode of operation said further ion trap is maintained at a pressure selected from the group consisting of: (i) greater than or equal to 0.0001 mbar; (ii) greater than or equal to 0.0005 mbar; (iii) greater than or equal to 0.001 mbar; (iv) greater than or equal to 0.005 mbar; (v) greater than or equal to 0.01 mbar; (vi) greater than or equal to 0.05 mbar; (vii) greater than or equal to 0.1 mbar; (viii) greater than or equal to 0.5 mbar; (ix) greater than or equal to 1 mbar; (x) greater than or equal to 5 mbar; and (xi) greater than or equal to 10 mbar.

17. A mass spectrometer as claimed in claim 1, wherein in said first mode of operation said further ion trap is maintained at a pressure selected from the group consisting of: (i) less than or equal to 10 mbar; (ii) less than or equal to 5 mbar; (iii) less than or equal to 1 mbar; (iv) less than or equal to 0.5 mbar; (v) less than or equal to 0.1 mbar; (vi) less than or equal to 0.05 mbar; (vii) less than or equal to 0.01 mbar; (viii) less than or equal to 0.005 mbar; (ix) less than or equal to 0.001 mbar; (x) less than or equal to 0.0005 mbar; and (xi) less than or equal to 0.0001 mbar.

18. A mass spectrometer as claimed in claim 1, wherein in said first mode of operation said further ion trap is maintained at a pressure selected from the group consisting of: (i) between 0.0001 and 10 mbar; (ii) between 0.0001 and 1 mbar; (iii) between 0.0001 and 0.1 mbar; (iv) between 0.0001 and 0.01 mbar; (v) between 0.0001 and 0.001 mbar; (vi) between 0.001 and 10 mbar; (vii) between 0.001 and 1 mbar; (viii) between 0.001 and 0.1 mbar; (ix) between 0.001 and 0.01 mbar; (x) between 0.01 and 10 mbar; (xi) between 0.01 and 1 mbar; (xii) between 0.01 and 0.1 mbar; (xiii) between 0.1 and 10 mbar; (xiv) between 0.1 and 1 mbar; and (xv) between 1 and 10 mbar.

19. A mass spectrometer as claimed in claim 1, wherein in a second mode of operation ions are pulsed out of or ejected from said further ion trap in a non mass-selective or a non-scanning manner.

20. A mass spectrometer as claimed in claim 19, wherein in said second mode of operation ions are pulsed out of or ejected from said further ion trap by applying one or more DC voltage extraction pulses to said further ion trap.

21. A mass spectrometer as claimed in claim 20, wherein in said second mode of operation said one or more DC extraction voltages are applied to one or more end or end-cap electrodes of said further ion trap.

22. A mass spectrometer as claimed in claim 20, wherein in said second mode of operation said one or more DC extraction voltages are applied to one or more central or ring electrodes of said further ion trap.

23. A mass spectrometer as claimed in claim 19, wherein in said second mode of operation AC or RF voltages are not substantially applied to the electrodes of said further ion trap.

24. A mass spectrometer as claimed in claim 19, wherein in said second mode of operation said further ion trap is maintained at a lower pressure than when said further ion trap is operated in said first mode of operation.

25. A mass spectrometer as claimed in claim 24, wherein said further ion trap is maintained at a pressure selected from the following group when operated in said second mode of operation: (i) $<5\times10^{-2}$ mbar; (ii) $<10^{-2}$ mbar; (iii) $<5\times10^{-3}$ mbar; (iv) $<10^{-3}$ mbar; (v) $<5\times10^{-4}$ mbar; (vi) $<10^{-4}$ mbar; (vii) $<5\times10^{-5}$ mbar; (viii) $<10^{-5}$ mbar; (ix) $<5\times10^{-6}$ mbar; and (x) $<10^{-6}$ mbar.

26. A mass spectrometer as claimed in claim 19, wherein in said first mode of operation a pulse of ions ejected from said quadrupole ion trap and received by said further ion trap has a first range of energies $\Delta E_1$ and wherein in said second mode of operation ions ejected from said further ion trap have a second range of energies $\Delta E_2$, wherein $\Delta E_2<\Delta E_1$.

27. A mass spectrometer as claimed in claim 26, wherein $\Delta E_1/\Delta E_2$ is at least 5, 10, 15, 20, 25, 30, 35, 40, 45, 50, 55, 60, 65, 70, 75, 80, 85, 90, 95 or 100.

28. A mass spectrometer as claimed in claim 26, wherein $\Delta E_1$ is at least 1, 2, 3, 4, 5, 6, 7, 8, 9 or 10 eV.

29. A mass spectrometer as claimed in claims 26, wherein $\Delta E_2$ is a maximum of 1, 0.9, 0.8, 0.7, 0.6, 0.5, 0.4, 0.3, 0.2, 0.1, 0.09, 0.08, 0.07, 0.06, 0.05, 0.04, 0.03, 0.02 or 0.01 eV.

30. A mass spectrometer as claimed in claim 1, further comprising a continuous or pulsed ion source.

31. A mass spectrometer as claimed in claim 30, wherein said ion source is selected from the group consisting of: (i) an Electrospray ion source; (ii) an Atmospheric Pressure Chemical Ionisation ("APCI") ion source; (iii) an Atmospheric Pressure MALDI ion source; (iv) an Electron Ionisation ("EI") ion source; (v) a Chemical Ionisation ("CI") ion source; and (vi) a Field Desorption Ionisation ("FI") ion source.

32. A mass spectrometer as claimed in claim 30, wherein said ion source is selected from the group consisting of: (i) a Matrix Assisted Laser Desorption Ionisation ("MALDI") ion source; (ii) a Laser Desorption Ionisation ("LDI") ion source; (iii) a Laser Desorption/Ionization on Silicon ("DIOS") ion source; (iv) a Surface Enhanced Laser Desorption Ionisation ("SELDI") ion source; and (v) a Fast Atom Bombardment ("FAB") ion source.

33. A method of mass spectrometry, comprising:

providing a quadrupole ion trap, a further ion trap arranged to receive ions ejected from said quadrupole ion trap and a Time of Flight mass analyser arranged to receive and analyze only parent ions ejected from said further ion trap;

mass-selectively ejecting from or scanning out of said quadrupole ion trap a pulse of parent ions in a first mode of operation wherein said further ion trap receives said pulse of ions and wherein the ratio of the maximum mass to charge ratio of ions in the pulse of ions tote minimum mass to charge ratio of parent ions in the pulse of ions is a maximum of x, and wherein $x\leqq4.0$; and collisionally cooling the parent ions received from said quadrupole ion trap within said further ion trap.

34. A method as claimed in claim 33, further comprising maintaining in said first mode of operation said further ion trap at a pressure selected from the group consisting of: (i) greater than or equal to 0.0001 mbar; (ii) greater than or equal to 0.0005 mbar; (iii) greater than or equal to 0.001 mbar; (iv) greater than or equal to 0.005 mbar; (v) greater than or equal to 0.01 mbar; (vi) greater than or equal to 0.05 mbar; (vii) greater than or equal to 0.1 mbar; (viii) greater than or equal to 0.5 mbar; (ix) greater than or equal to 1 mbar; (x) greater than or equal to 5 mbar; and (xi) greater than or equal to 10 mbar.

35. A method as claimed in claim 33, further comprising maintaining in said first mode of operation said further ion trap at a pressure selected from the group consisting of: (i) less than or equal to 10 mbar; (ii) less than or equal to 5 mbar; (iii) less than or equal to 1 mbar; (iv) less than or equal to 0.5 mbar; (v) less than or equal to 0.1 mbar; (vi) less than or equal to 0.05 mbar; (vii) less than or equal to 0.01 mbar; (viii) less than or equal to 0.005 mbar; (ix) less than or equal to 0.001 mbar; (x) less than or equal to 0.0005 mbar; and (xi) less than or equal to 0.0001 mbar.

36. A method as claimed in claim 33, further comprising maintaining in said first mode of operation said further ion trap at a pressure selected from the group consisting of: (i) between 0.0001 and 10 mbar; (ii) between 0.0001 and 1 mbar; (iii) between 0.0001 and 0.1 mbar; (iv) between 0.0001 and 0.01 mbar; (v) between 0.0001 and 0.001 mbar; (vi) between 0.001 and 10 mbar; (vii) between 0.001 and 1 mbar; (viii) between 0.001 and 0.1 mbar; (ix) between 0.001 and 0.01 mbar; (x) between 0.01 and 10 mbar; (xi) between 0.01 and 1 mbar; (xii) between 0.01 and 0.1 mbar; (xiii) between 0.1 and 10 mbar; (xiv) between 0.1 and 1 mbar; and (xv) between 1 and 10 mbar.

37. A method as claimed in claim 33, further comprising ejecting ions or pulsing out ions in a non-mass selective or a non-scanning manner from said further ion trap in a second mode of operation.

38. A method as claimed in claim 37, wherein in said second mode of operation ions are pulsed out of or ejected from said further ion trap by applying one or more DC voltage extraction pulses to said further ion trap.

39. A method as claimed in claim 38, wherein in said second mode of operation said one or more DC extraction voltages are applied to one or more end or end-cap electrodes of said further ion trap.

40. A method as claimed in claim 38, wherein in said second mode of operation said one or more DC extraction voltages are applied to one or more central or ring electrodes of said further ion trap.

41. A method as claimed in claim 37, wherein in said second mode of operation AC or RF voltages are not substantially applied to the electrodes of said further ion trap.

42. A method as claimed in claim 37, wherein in said second mode of operation said further ion trap is maintained at a lower pressure than when in said first mode of operation.

43. A method as claimed in claim 42, wherein said further ion trap is maintained at a pressure selected from the following group when operated in said second mode of operation: (i) $<5\times10^{-2}$ mbar; (ii) $<10^{-2}$ mbar; (iii) $<5\times10^{-3}$ mbar; (iv) $<10^{-3}$ mbar; (v) $<5\times10^{-4}$ mbar; (vi) $<10^{-4}$ mbar; (vii) $<5\times10^{-5}$ mbar; (viii) $<10^{-5}$ mbar; (ix) $<5\times10^{-6}$ mbar; and (x) $<10^{-6}$ mbar.

44. A method as claimed in claim 37, wherein in said first mode of operation a pulse of ions ejected from said quadrupole ion trap and received by said further ion trap has a first range of energies $\Delta E_1$ and wherein in said second mode of operation ions ejected from said further ion trap have a second range of energies $\Delta E_2$, wherein $\Delta E_2<\Delta E_1$.

45. A method as claimed in claim 44, wherein $\Delta E_1/\Delta E_2$ is at least 5, 10, 15, 20, 25, 30, 35, 40, 45, 50, 55, 60, 65, 70, 75, 80, 85, 90, 95 or 100.

46. A method as claimed in claim 44, wherein $\Delta E_1$ is at least 1, 2, 3, 4, 5, 6, 7, 8, 9 or 10 eV.

47. A method as claimed in claim 44, wherein $\Delta E_2$ is a maximum of 1, 0.9, 0.8, 0.7, 0.6, 0.5, 0.4, 0.3, 0.2, 0.1, 0.09, 0.08, 0.07, 0.06, 0.05, 0.04, 0.03, 0.02 or 0.01 eV.

* * * * *